US010087612B2

(12) United States Patent
Brown et al.

(10) Patent No.: US 10,087,612 B2
(45) Date of Patent: Oct. 2, 2018

(54) FLOOR SHIELD

(71) Applicant: Fresh Products, Inc., Toledo, OH (US)

(72) Inventors: Douglas S. Brown, Toledo, OH (US); Jeffrey A. Smith, Perrysburg, OH (US)

(73) Assignee: Fresh Products, Inc., Toledo, OH (US)

( * ) Notice: Subject to any disclaimer, the term of this patent is extended or adjusted under 35 U.S.C. 154(b) by 0 days.

(21) Appl. No.: 14/618,890

(22) Filed: Feb. 10, 2015

(65) Prior Publication Data

US 2015/0225937 A1 Aug. 13, 2015

Related U.S. Application Data

(60) Provisional application No. 61/939,164, filed on Feb. 12, 2014, provisional application No. 61/940,271, filed on Feb. 14, 2014, provisional application No. 62/001,524, filed on May 21, 2014, provisional application No. 62/001,533, filed on May 21, 2014.

(51) Int. Cl.
*A47K 17/00* (2006.01)
*E03D 13/00* (2006.01)

(52) U.S. Cl.
CPC ..... *E03D 13/005* (2013.01); *A47K 17/00* (2013.01)

(58) Field of Classification Search
CPC ..... A47K 17/00; A47K 2010/3222; A47K 2010/3246; A47K 2010/3253; E03D 13/005
USPC ..... 4/661, 251.1, 251.2; 248/200, 309.1, 248/205.1, 206.5, 309.4, 683, 685, 480, 248/239.1, 244, 271, 298.1, 900; 211/119.009
See application file for complete search history.

(56) References Cited

U.S. PATENT DOCUMENTS

| | | | |
|---|---|---|---|
| 333,935 | A | 1/1886 | Duncan |
| 555,888 | A | 3/1896 | Roberts |
| 810,973 | A | 1/1906 | Pattenden |
| 927,026 | A | 7/1909 | Clayton |
| 950,574 | A | 3/1910 | Morgan |
| 1,109,904 | A | 9/1914 | Dahlgren |
| 1,208,675 | A | 12/1916 | Sleight |
| 1,260,082 | A | 3/1918 | Sleight |
| 1,292,856 | A | 1/1919 | Niblo |
| 1,731,431 | A | 10/1929 | Meyer |

(Continued)

FOREIGN PATENT DOCUMENTS

| | | |
|---|---|---|
| DE | 1915249 | 10/1970 |
| DE | 19541911 A1 | 5/1997 |

(Continued)

OTHER PUBLICATIONS

International Search Report and Written Opinion for application No. PCT/US2015/015277 dated Apr. 23, 2015.

(Continued)

*Primary Examiner* — Erin Deery
(74) *Attorney, Agent, or Firm* — Knobbe Martens Olson and Bear LLP

(57) ABSTRACT

Disclosed herein is a floor shield which can be located above the floor below a urinal. The floor shield can protect a user's clothing, such as shoes and pants, from being soiled while using a urinal. In some embodiments, the floor shield can have a liquid absorbing mat contained between frame elements. The absorbing mat can easily be removed and replaced when the mat is dirty.

21 Claims, 33 Drawing Sheets

(56) References Cited

U.S. PATENT DOCUMENTS

| | | | | |
|---|---|---|---|---|
| 1,859,328 | A | 5/1932 | Piper | |
| 1,880,962 | A | 10/1932 | Koppelman | |
| 1,886,676 | A | 11/1932 | Heuacker | |
| 1,935,128 | A | 11/1933 | Pullman | |
| 2,011,732 | A | 8/1935 | Saeks | |
| 2,020,864 | A | 11/1935 | Aronson et al. | |
| 2,087,592 | A | 7/1937 | Chesnut | |
| 2,211,970 | A | 8/1940 | Fischer | |
| 2,233,234 | A | 2/1941 | Wilson | |
| 2,447,178 | A | 8/1948 | Hatchette | |
| 2,506,669 | A | 5/1950 | Heaucker | |
| 2,508,808 | A | 5/1950 | Warman | |
| 2,679,054 | A | 5/1954 | Singleton | |
| 2,690,569 | A | 10/1954 | Kozerski | |
| 2,711,860 | A * | 6/1955 | Layton | A47K 10/40 242/564 |
| 2,931,047 | A | 4/1960 | Stebbins | |
| 2,984,841 | A | 5/1961 | Wilson | |
| 3,029,035 | A * | 4/1962 | Layton | A47K 10/32 206/394 |
| 3,170,169 | A | 2/1965 | Clark | |
| 3,268,920 | A | 8/1966 | Beer | |
| 3,329,998 | A | 7/1967 | Stohr | |
| 3,387,069 | A | 6/1968 | Stohr | |
| 3,540,433 | A | 11/1970 | Brockman | |
| 3,575,328 | A * | 4/1971 | Jespersen | B65H 35/002 225/106 |
| 3,597,772 | A | 8/1971 | Leavitt et al. | |
| 3,614,790 | A | 10/1971 | Billingsly et al. | |
| 3,631,560 | A | 1/1972 | Atkins | |
| 3,723,998 | A | 4/1973 | Wehr | |
| 3,752,121 | A | 8/1973 | Brazzell | |
| 3,788,485 | A | 1/1974 | Bruning | |
| 3,837,988 | A | 9/1974 | Hennen et al. | |
| 3,867,953 | A | 2/1975 | Stohr | |
| 3,899,192 | A | 8/1975 | Reddaway | |
| 3,923,442 | A | 12/1975 | Stohr | |
| 3,935,602 | A | 2/1976 | Kale | |
| 4,010,497 | A | 3/1977 | Menter et al. | |
| 4,103,367 | A | 8/1978 | Kaufer | |
| 4,215,443 | A | 8/1980 | Babik | |
| D258,181 | S | 2/1981 | Adam | |
| D258,472 | S | 3/1981 | Adam | |
| 4,285,075 | A * | 8/1981 | Nelson | A47K 17/00 4/251.1 |
| 4,361,606 | A | 11/1982 | Butler et al. | |
| 4,418,432 | A | 12/1983 | Vidal | |
| 4,490,862 | A | 1/1985 | Vidal | |
| D280,267 | S | 8/1985 | Bryant et al. | |
| 4,557,863 | A | 12/1985 | Callewaert et al. | |
| 4,574,400 | A | 3/1986 | Annowsky | |
| 4,574,403 | A | 3/1986 | Dintemann et al. | |
| 4,604,357 | A | 8/1986 | Callewaert et al. | |
| 4,612,676 | A | 9/1986 | Whitman | |
| 4,617,976 | A | 10/1986 | Vidal | |
| 4,671,976 | A | 1/1987 | Vidal | |
| 4,750,219 | A | 6/1988 | Williams | |
| 4,866,793 | A | 9/1989 | Luedtke et al. | |
| 4,985,940 | A | 1/1991 | Jones | |
| 5,010,599 | A | 4/1991 | Nilsson | |
| D329,893 | S | 9/1992 | Luedtke et al. | |
| 5,150,481 | A | 9/1992 | Pang | |
| 5,165,119 | A | 11/1992 | Yamato | |
| D341,414 | S | 11/1993 | Baker | |
| 5,309,578 | A | 5/1994 | Temple, Sr. | |
| 5,313,672 | A | 5/1994 | Luedtke et al. | |
| 5,336,424 | A | 8/1994 | Van Vlahakis et al. | |
| 5,365,616 | A | 11/1994 | Morad | |
| 5,377,362 | A | 1/1995 | Jackson | |
| 5,398,347 | A | 3/1995 | Luedtke et al. | |
| 5,448,783 | A | 9/1995 | Ryan | |
| 5,482,007 | A | 1/1996 | Kumlin | |
| 5,489,415 | A | 2/1996 | Van Vlahakis et al. | |
| 5,496,300 | A | 3/1996 | Hirsch et al. | |
| D370,938 | S | 6/1996 | Roach | |
| 5,556,685 | A | 9/1996 | Swicegood, Jr. | |
| 5,604,937 | A | 2/1997 | Davenport | |
| D393,896 | S | 4/1998 | Wagner et al. | |
| 5,774,905 | A | 7/1998 | Wager et al. | |
| 5,813,058 | A | 9/1998 | Quigley et al. | |
| 5,961,148 | A | 10/1999 | Cheng | |
| 6,055,681 | A | 5/2000 | Lyons | |
| D427,295 | S | 6/2000 | Wagner | |
| 6,081,937 | A | 7/2000 | Whitacre | |
| D438,710 | S | 5/2001 | Chen | |
| D442,246 | S | 5/2001 | McCabe et al. | |
| 6,265,084 | B1 | 7/2001 | Stickler | |
| 6,305,034 | B1 * | 10/2001 | Perez Urrutia | A47K 17/00 4/144.2 |
| D456,492 | S | 4/2002 | Lourens | |
| 6,370,705 | B1 | 4/2002 | Levinson | |
| D464,122 | S | 10/2002 | Mangan | |
| 6,503,326 | B1 * | 1/2003 | Mikelionis | A47K 10/32 118/419 |
| 6,698,035 | B1 | 3/2004 | Grueser | |
| 6,787,210 | B2 | 9/2004 | Stickler | |
| 6,862,754 | B1 | 3/2005 | DeMarco | |
| 6,920,648 | B1 | 7/2005 | Suski et al. | |
| D520,610 | S | 5/2006 | Wrate | |
| 7,921,478 | B1 | 4/2011 | Vanini | |
| D639,410 | S | 6/2011 | Ramirez | |
| 8,209,786 | B2 | 7/2012 | Aguila | |
| 8,856,977 | B2 | 10/2014 | Ramirez | |
| 2002/0020016 | A1 | 2/2002 | Lyons | |
| 2005/0009425 | A1 | 1/2005 | Foote | |
| 2005/0144711 | A1 | 7/2005 | Valadez et al. | |
| 2015/0240469 | A1 * | 8/2015 | Lowe | E03D 13/005 4/301 |
| 2016/0051101 | A1 * | 2/2016 | Long | A47G 27/0225 4/251.1 |

FOREIGN PATENT DOCUMENTS

| | | |
|---|---|---|
| FR | 2681232 | 3/1993 |
| GB | 189518394 | 8/1896 |
| GB | 409437 | 5/1934 |
| JP | 57-17599 | 1/1982 |
| JP | 60-178497 | 11/1985 |
| JP | 60-190865 | 12/1985 |
| JP | 63-116585 | 7/1988 |
| JP | 1990-102625 A | 4/1990 |
| JP | 1992-119880 U | 10/1992 |
| JP | 2001-303642 | 10/2001 |
| KR | 0368846 U | 11/2004 |
| KR | 10-2008-0110225 A | 12/2008 |
| KR | 10-1209013 B1 | 11/2012 |
| WO | WO 99/027202 | 6/1999 |
| WO | WO 1999/067470 | 12/1999 |

OTHER PUBLICATIONS

Ritter, R. C. et al., "Analysis of Drop Intervals in Jets Modelling Obstruction of the Urinary Tract," 1974. PHYS MED BIOL., 1974, vol. 19, No. 2, 161-170, 11 pages.

Ritter, R. C. et al., "Physical Information in the External Urinary Stream of the Normal and Obstructed Adult Male, " British Journal of Urology (1977), 49, 293-302, 10 pages.

Gray, Henry. Anatomy of the Human Body. 1918 (1821-1895). The Male Urethra, http://www.bartleby.com/107/256.html, retrieved on Oct. 27, 2014. 5 pages.

Dugdale, David C., Uroflometry, 2008. http://www.nlm.nih.gov/medlineplus/ency/article/003325.htm, retrieved on Oct. 28, 2014, 2 pages.

* cited by examiner

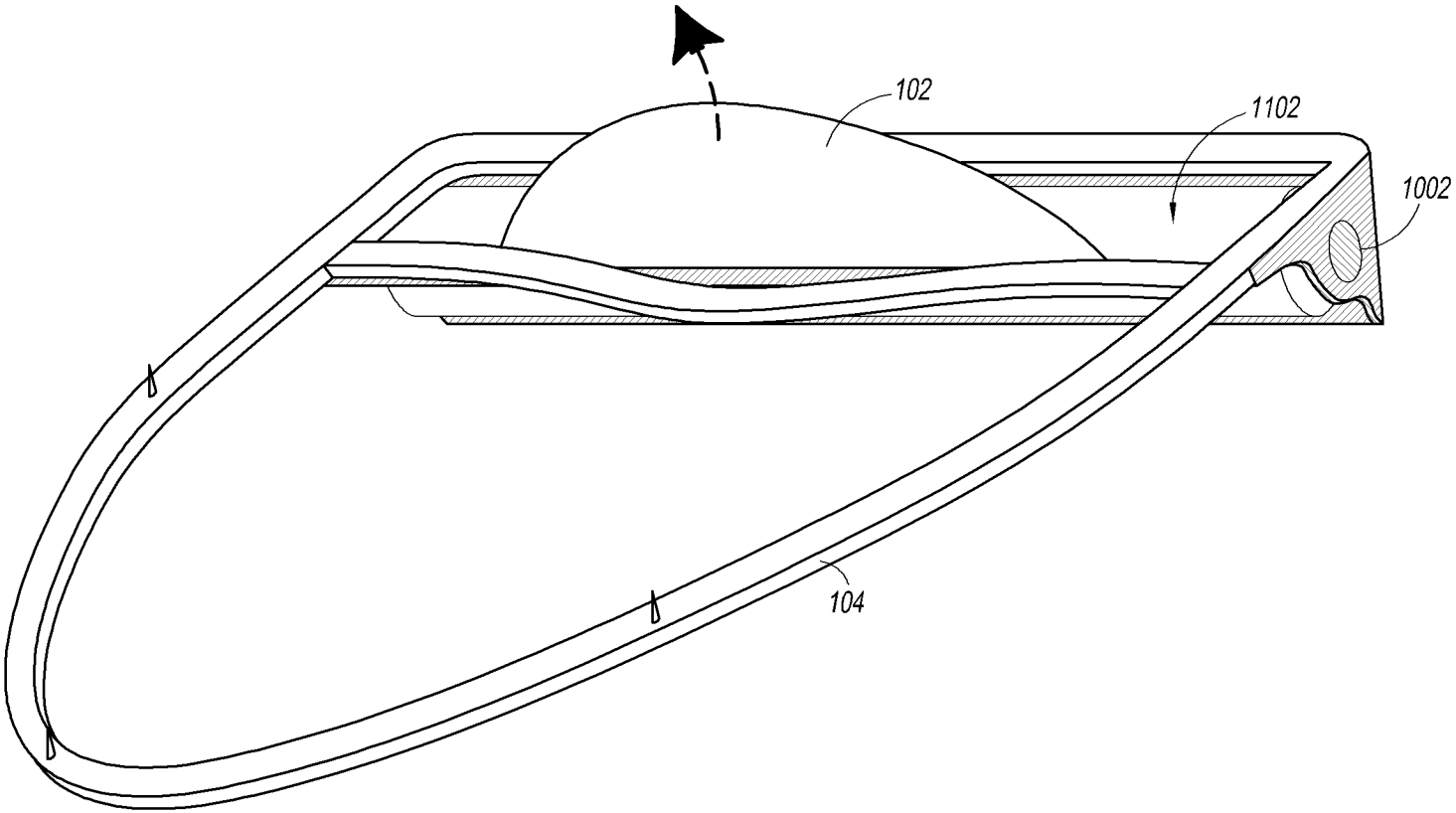
FIG. IIB

FLOOR SHIELD

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

This disclosure relates generally to embodiments of a protective shield for use with a urinal.

SUMMARY

Disclosed herein is a floor shield and floor shield assemblies which can comprise a frame structure, a replaceable mat sized to be supported by the frame structure, wherein the mat is desirably sized so that the mat can be retained within the frame structure, and a bracket configured to hold the frame structure.

In some embodiments, a portion of the floor shield assembly, such as the bracket can comprise a container carrying replacement mats. In some embodiments, the frame structure can be configured to move horizontally within the bracket. In some embodiments, the frame structure can be configured to move vertically and/or horizontally within the bracket. In some embodiments, the frame structure can comprise a top and bottom portion, the top and bottom portion connected by an attachment structure, and the replaceable mat located between the top and bottom portions of the frame structure.

In some embodiments, at least the top or bottom portion of the frame structure can comprise at least one fastening element. In some embodiments, the at least one fastening element can comprise a locking pin or snap.

In some embodiments, the bottom portion of the frame structure can contain a resting platform configured to support the replaceable mat. In some embodiments, the attachment structure can be a hinge. In some embodiments, the frame structure can be a generally half elliptical shape. In some embodiments, the frame structure can be configured to rotate vertically, such as within the bracket. In some embodiments, the bracket can comprise at least one gear. In some embodiments, the floor shield can further comprise at least one support leg extending from the frame structure. In some embodiments, the frame structure can be configured to be releasably retained by the bracket. In some embodiments, a releasable retainer attached to a bottom of the frame structure can be used to retain the mat within the frame structure. In some embodiments, the releasable retainer can be attached to the bottom of the frame structure at least in part by at least one hinge. In some embodiments, air freshener can be incorporated into at least one of the frame structure, the replaceable mat, and the bracket.

Also disclosed herein is system for clothing protection in a restroom which can comprise a wall and a floor and at least one floor shield which can comprise a frame structure, a replaceable mat sized to be supported by the frame structure, wherein the mat is desirably sized so that the mat can be retained within the frame structure, and a bracket configured to retain the frame structure, wherein the bracket is attached to the wall, wherein the at least one floor shield is spaced away from a floor of the restroom.

In some embodiments, the bracket can be integrally formed with the wall. In some embodiments, the system can further comprise a plurality of floor shields. In some embodiments, the system can further comprise a urinal attached to the wall, wherein the at least one floor shield is spaced below the urinal. In some embodiments, the frame structure can comprise a top and bottom portion, the top and bottom portion connected by an attachment structure, and the replaceable mat located between the top and bottom portions of the frame structure. In some embodiments, the frame structure can be a generally half elliptical shape.

Disclosed herein are embodiments of a floor shield assembly comprising a frame structure comprising an upper frame portion, and a lower frame portion, wherein the upper and lower frame portions are connected by an attachment structure, and wherein the upper frame portion is configured to move between an open and a closed configuration, at least one replaceable mat, wherein the at least one replaceable mat can be retained between the upper and lower frame portions of the frame structure when the upper frame portion is in the closed configuration, and a bracket configured to retain at least a portion of the frame structure, the bracket configured to connect to a wall, wherein the floor shield is configured to be located above a floor.

In some embodiments, the bracket can comprise a container defining a cavity for receiving replacement mats. In some embodiments, the container can comprise at least one removable boss for removal and replacement of the replacement mats.

In some embodiments, the frame structure can be configured to move horizontally with respect to the bracket. In some embodiments, at least one of the top or bottom portions of the frame structure can comprise at least one fastening element. In some embodiments, the at least one fastening element can comprise a locking pin or snap. In some embodiments, the attachment structure can be a hinge.

In some embodiments, the frame structure can be a generally half elliptical shape. In some embodiments, the frame structure can be configured to rotate with respect to the bracket about an axis.

In some embodiments, the floor shield assembly can further comprise a releasable retainer attached to a bottom of the lower frame portion and configured to secure a mat to the frame structure. In some embodiments, air freshener can be incorporated into at least one of the frame structure, the replaceable mat, and the bracket. In some embodiments, the floor shield assembly can further comprise a locking mechanism to hold at least one of upper frame portion and the lower frame portion in the closed configuration.

In some embodiments, the floor shield assembly can further comprise a plurality of replaceable mats, in addition to the at least one replacement mat. In some embodiments, said plurality of replaceable mats can be positioned on a roll. In some embodiments, said plurality of replaceable mats can be connected to said at least one replaceable mat. In some embodiments, said plurality of replaceable mats can be configured to be connected to said at least one replaceable mat while the at least one replaceable mat is retained between the upper and lower frame portions of the frame structure.

Also disclosed herein are embodiments of a system for clothing protection in a restroom comprising a wall, at least one urinal attached to the wall, and at least one floor shield assembly comprising a frame structure, a replaceable mat sized to be supported by the frame structure, wherein the mat is securable to the frame structure, and a bracket configured to retain the frame structure, wherein the bracket is attached to the wall, wherein the replaceable mat is positioned to protect a user from splashing of urine and is spaced from a floor of the restroom.

In some embodiments, the bracket can be integrally formed with the wall. In some embodiments, the system can further comprise a plurality of floor shields. In some embodiments, the at least one floor shield can be spaced below the urinal. In some embodiments, the frame structure can comprise a top and bottom portion, the top and bottom portion connected by an attachment structure, and the replaceable mat located between the top and bottom portions of the frame structure. In some embodiments, the frame structure can be a generally half elliptical shape.

Also disclosed herein are embodiments of a floor shield assembly comprising a frame structure, at least one replaceable mat, wherein the at least one replaceable mat can be retained against the frame structure, and a bracket configured to retain at least a portion of the frame structure, the bracket configured to connect to a wall, wherein the floor shield is configured to be located above a floor. In some embodiments, the bracket and the frame structure can be integrally formed.

BRIEF DESCRIPTION OF THE DRAWINGS

FIGS. 11A-C illustrate an embodiment of floor shield having a bracket with replacement mats.

FIG. 21 illustrates a step in the installation of a mat into an embodiment of a floor shield.

DETAILED DESCRIPTION

Urinals can be a significant source of unwanted staining on a person's clothing, especially pants and shoes. For example, due to the currently used shape of urinals, excess liquids, such as water, cleaning chemicals, and/or urine (e.g, from splash-back or drippage) can spill over the edge of the urinal and directly downwards. Because of the location of the urinal, a user's feet would be directly in the area of the spillage, and could lead to damage to the user's clothing. Further, the liquids could splash, thus damaging the pant legs of the user of the urinal. Additionally, spillage can lead to puddles on the ground in a restroom, even when a floor urinal mat is used, which are not merely unsightly but can actually begin to substantially damage the floor or the soles of a person's shoes. It can be expensive to fix any damage done to the floor by the uric acid In the past, floor mats have been used in restrooms in an attempt to reduce urine and other chemical/liquid levels on the restroom floor. Urine is a significant damager of floors, and can etch or eat away from the floor, and thus it is advantageous to prevent urine from remaining on a floor. While floor mats have typically been used, the restroom environment is harsh on them, both physically and chemically, and the floor mats can quickly collect urine and other chemicals. As users do not want to stand on a urine filled floor mat, they stand aside the floor mats, thus exacerbating the damage to the floor. Further, as a result of the harsh environment, floor mats can quickly lose their air freshening or sanitizing function, become torn so that debris is permitted through them, or become unsightly. Therefore, floor mats need to be changed relatively often to function properly without drawing undue attention. In addition, floor mats can easily be kicked aside, thus eliminating any usefulness in protecting the restroom floor.

Disclosed herein is a device, assembly, and/or system acting as a floor shield, which can prevent liquids from falling from the urinal area and onto the floor and/or a user's clothing. Accordingly, this can prevent clothing from being damaged, as well as improve sanitation in a restroom. Further, embodiments of the floor shield can remain above the floor of a restroom, thus significantly reducing the wear and damage to the floor shield facility, being used effectively for a longer period of time. In addition, being above the floor can allow for the floor shield to catch more liquid than similar sized urinal mats located on the floor. In some embodiments, the floor shield assembly can include the floor shield itself, as well as any connection or retaining pieces. However, the terms floor shield and floor shield assembly can be used interchangeably in some embodiments.

Figure 1:
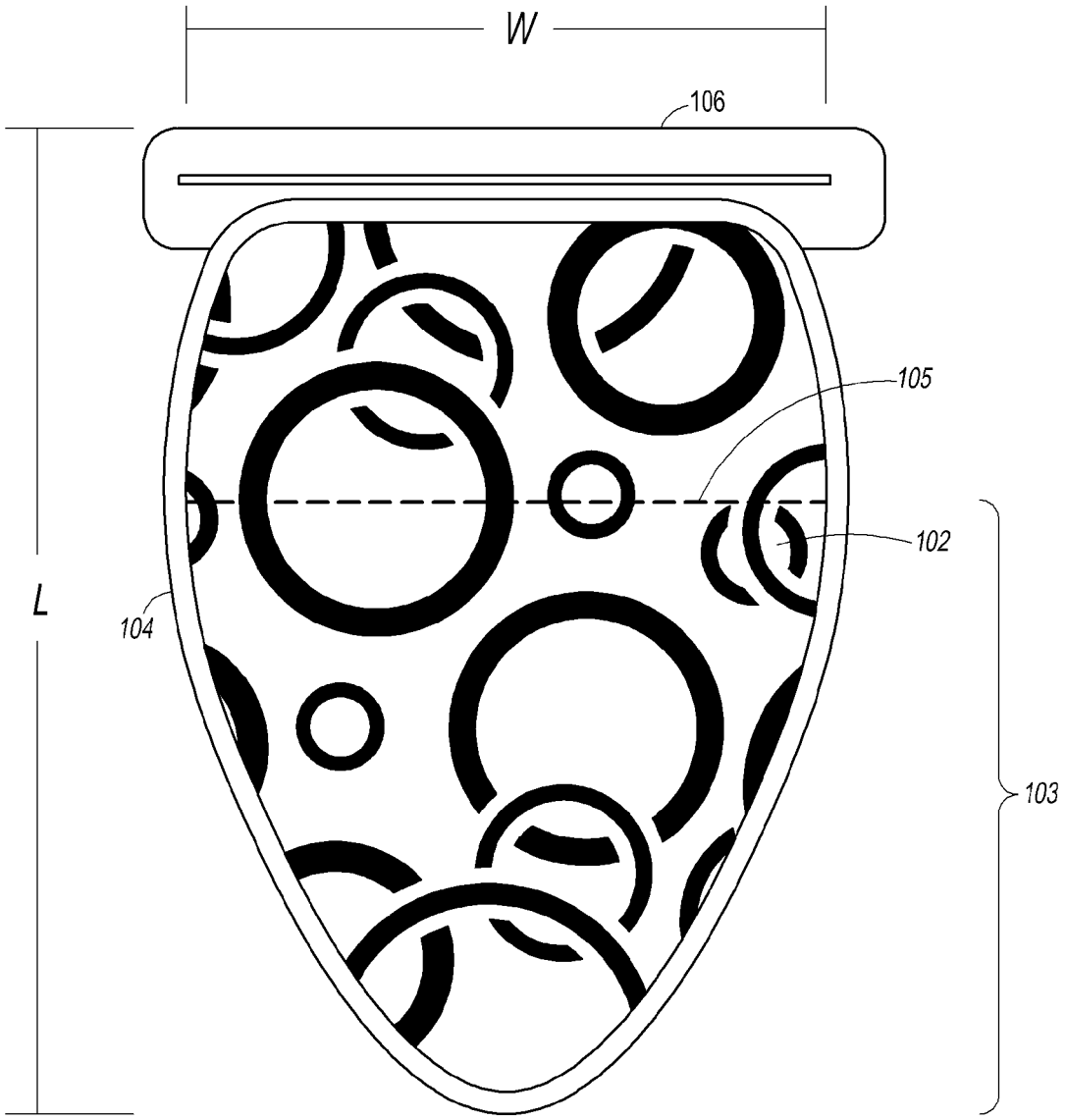
FIG. 1 illustrates a top-down view of an embodiment of a floor shield.

FIG. 1 illustrates an embodiment of a floor shield. As shown in the figure, the floor shield can have a mat 102 and a frame (or hoop) 104. In some embodiments, the mat 102 can be blank, printed, or have advertising on it. In some embodiments, the mat 102 can contain colorful patterns that show through the frame 104. Further, the mat 102 can contain a signal, such as a color change, for when the mat 102 should be removed and replaced. In some embodiments, the mat can be an absorbing mat or pad for collecting any fluids that fall from a urinal. In some embodiments, the mat 102 can be made of fabric, cloth, polymer, paper (such as 2 ply toilet paper), absorbents, hydroscopic material, or natural material, and the type of material of the mat 102 does not limit this disclosure. In some embodiments, the mat 102 can contain anti-microbial additives.

Accordingly, most, if not all, liquid can be prevented from reaching the ground or a user's shoes, as most, if not all, liquid can be picked up and absorbed by the mat 102 which can be located directly below a urinal. In some embodiments, the floor shield can have a smaller upper surface area than floor mats of the prior art. In some embodiments, the floor shield can have an upper surface area of less than 1000, 900, 800, 700, 750, 625, 600, 500, 400, 300, 280, 270, or 200 $in^2$. Advantageously, however, the urinal can have an upper surface area of a sufficient size to protect against urine splattering the floor or the user's clothing. For example, embodiments of the floor shield can have an upper surface area of at least 25, 30, 35, 40, 45, 50, 55, 60, 65, 70, 75, 80, 85, 90, 95, or 100 $in^2$. In some embodiments, the floor shield has an upper surface area of between 50 and 750, 64 and 625, 80 and 500, 140 and 400, 180 and 300, or 200 and 280 $in^2$. In some embodiments, the floor shield has an upper surface area of between 400 and 1600, 600 and 1200, or 800 and 1000 $in^2$.

In some embodiments, the mat 102 can have approximately the same size as the floor shield. In some embodiments, the mat 102 can be approximately 10, 11, 12, 13, 14, 15, 16, 17, 18, 19, 20, 21, 22, 23, 24, 25, 26, 27, 28, 29, or 30 inches long, as shown in FIG. 1. In some embodiments, the mat 102 can be greater than approximately 10, 11, 12, 13, 14, 15, 16, 17, 18, 19, 20, 21, 22, 23, 24, 25, 26, 27, 28, 29, or 30 inches long. In some embodiments, the mat 102 can be approximately 10, 11, 12, 13, 14, 15, 16, 17, 18, 19, 20, 21, 22, 23, 24, 25, 26, 27, 28, 29, or 30 inches wide, as shown in FIG. 1. In some embodiments, the mat 102 can be greater than approximately 10, 11, 12, 13, 14, 15, 16, 17, 18, 19, 20, 21, 22, 23, 24, 25, 26, 27, 28, 29, or 30 inches wide. In some embodiments, the mat 102 can less than approximately 40, 35, 30, 25, 20, or 16 inches long. In some embodiments, the mat 102 can less than approximately 40, 35, 30, 25, 20, or 16 inches wide.

In some embodiments, the frame 104 can lay both below and on top of the mat 102 and desirably hold it in place, e.g., sandwiching the mat 102, as further described in detail below. Further, the floor shield can contain a replacement box 106 which can contain one or more replacement mats 102. However, in some embodiments a box 106 is not used with the floor shield, and a simple bracket can be used, as described below. In some embodiments, the replacement box 106 can operate similar to a paper towel dispenser, wherein a user can pull out replacement mats 102 when the old mat 102 becomes soiled, though other methodologies can be used as well and do not limit the disclosure.

In some embodiments, the frame 104 can be in the shape of a partial ellipsoid, such as a half or ¾ ellipsoid. For example, the frame 104 can generally include a generally or substantially parabolic portion, wherein two points of the parabolic portion 103 are connected by a line 105, shown in FIG. 1. This shape can allow for a user to stand at a urinal with their feet underneath the floor shield, advantageously protecting the user's feet. Further, the shape of the frame 104 can allow for a user to stand comfortably around the frame with their legs apart, and thus do not have to stand in an awkward position. However, the particular shape of the frame 104 does not limit this disclosure, and different shapes can be used as well. For example, a generally triangular shape can be used as the frame of the floor shield. Further, in some embodiments the mat 102 can be shaped approximately the same as the frame 104 in order to fit neatly within the frame 104. However, in some embodiments the mat 102 can extend further than the frame 104. In some embodiments, the mat 102 can extend further than the frame 104 and can be partially wrapped around the frame 104, as discussed in more detail below.

Figure 2:
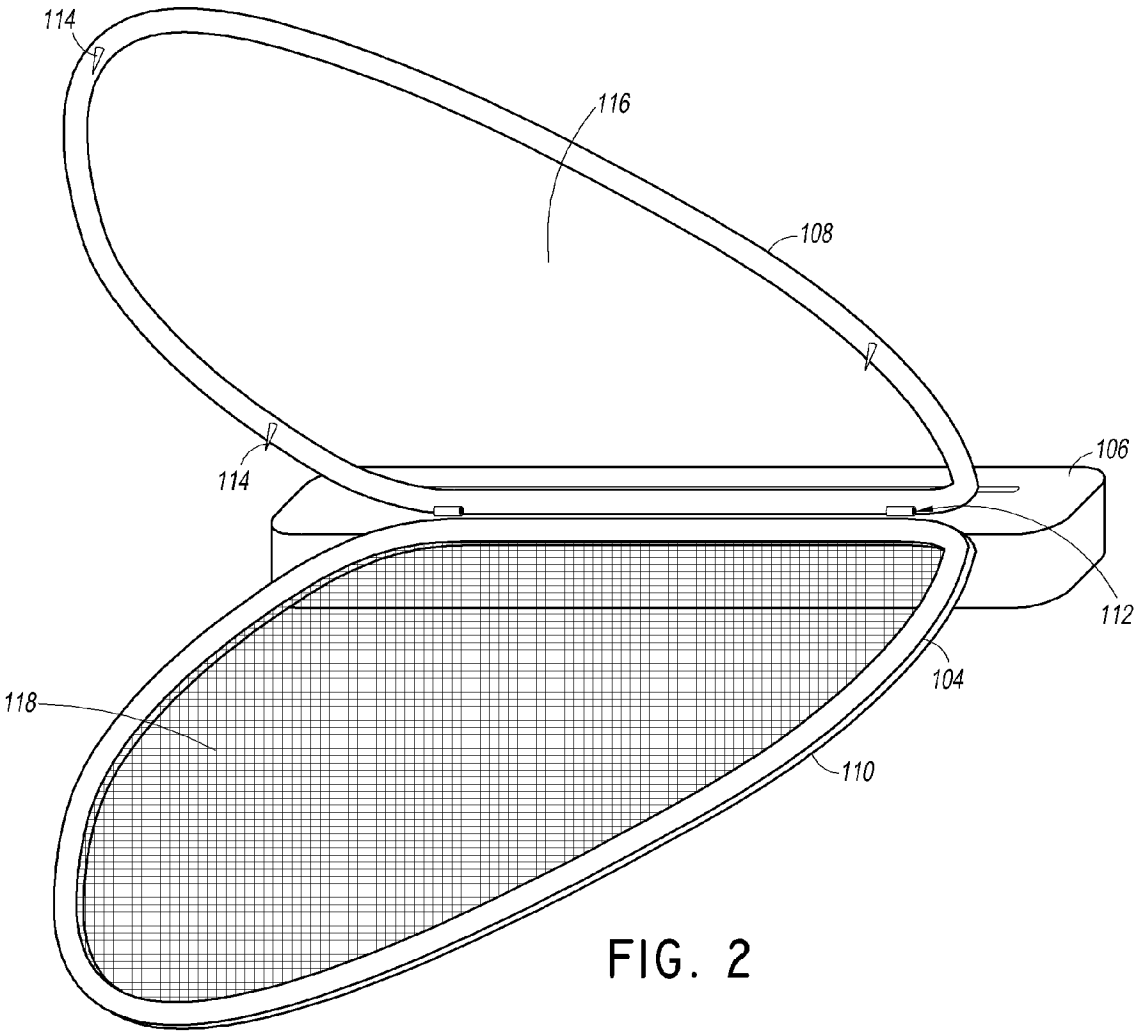
FIG. 2 illustrates an open hinge configuration of an embodiment of a floor shield.

FIG. 2 illustrates an embodiment of a floor shield with the frame 104 in an open position. As shown, in some embodiments the frame 104 can be made up of two portions, a top portion 108 and a bottom portion 110, connected to one another by one or more attachment elements, such as a hinge element 112, though the particular attachment element does not limit the disclosure. In some embodiments, no hinge may be used with the frame 104. In some embodiments, the hinge element 112 can be spring loaded so that it will automatically return the frame 104 to a closed position. In some embodiments, the top portion 108 and bottom portion 110 can be integrally formed. In some embodiments, the top portion 108, bottom portion 110, and hinge 112 can be integrally formed with one another. In some embodiments, the frame 104 could have only a top portion 108 or only a bottom portion 110, and the mat 102 can be secured, for example, to the top of the bottom portion 110 or the bottom of the top portion 108 with fastening elements as further described below.

In some embodiments, the top portion 108 can contain at least one fastening element 114. In some embodiments, the top portion 108 can contain 1, 2, 3, 4, 5, 6, 7, 8, 9, or 10 fastening elements 114. In some embodiments, the bottom portion 110 can also contain at least one fastening element. In some embodiments, the bottom portion 110 can contain 1, 2, 3, 4, 5, 6, 7, 8, 9, or 10 fastening elements 114. The number of fastening elements 144 does not limit the disclosure. The fastening elements 114 of the top portion 108 and bottom portion 110 may be the same, or may be different. These fastening elements 114 can be, for example, locking pins or snaps, though the type of fastening element does not limit this disclosure. In some embodiments, the top portion 108 and bottom portion 110 can have fastening elements 114 so that the fastening elements 114 on the top portion 108 and bottom portion 110 interlock with one another. For example, some fastening elements 114 can be female members, whereas others can be male members. In some embodiments, fastening elements are not used, and the frame can contain a mat 102 using only pressure or frictional forces. In some elements, the top portion 108 and bottom portion 110 can have magnetic materials on them, and thereby the top portion 108 and bottom 108 can be magnetically attracted to one another, thereby retaining the mat 102.

The top portion 108 and bottom portion 110 of the frame 104 can form an open area 116 inside their respective perimeters or circumferences. However, in some embodiments the frame 104 does not have an open area, and can be formed of a solid or gridded material, thus hiding the mat 102 from view by a user. In some embodiments, the bottom portion 110 can contain a resting platform 118 where a mat 102 can rest. This resting platform 118 can give further support to a mat 102 when the mat 102 is in place on the floor shield. The resting platform 118 can be made of an additional absorbing material, or can be made of a mesh that allows liquids to pass through.

Figure 3:
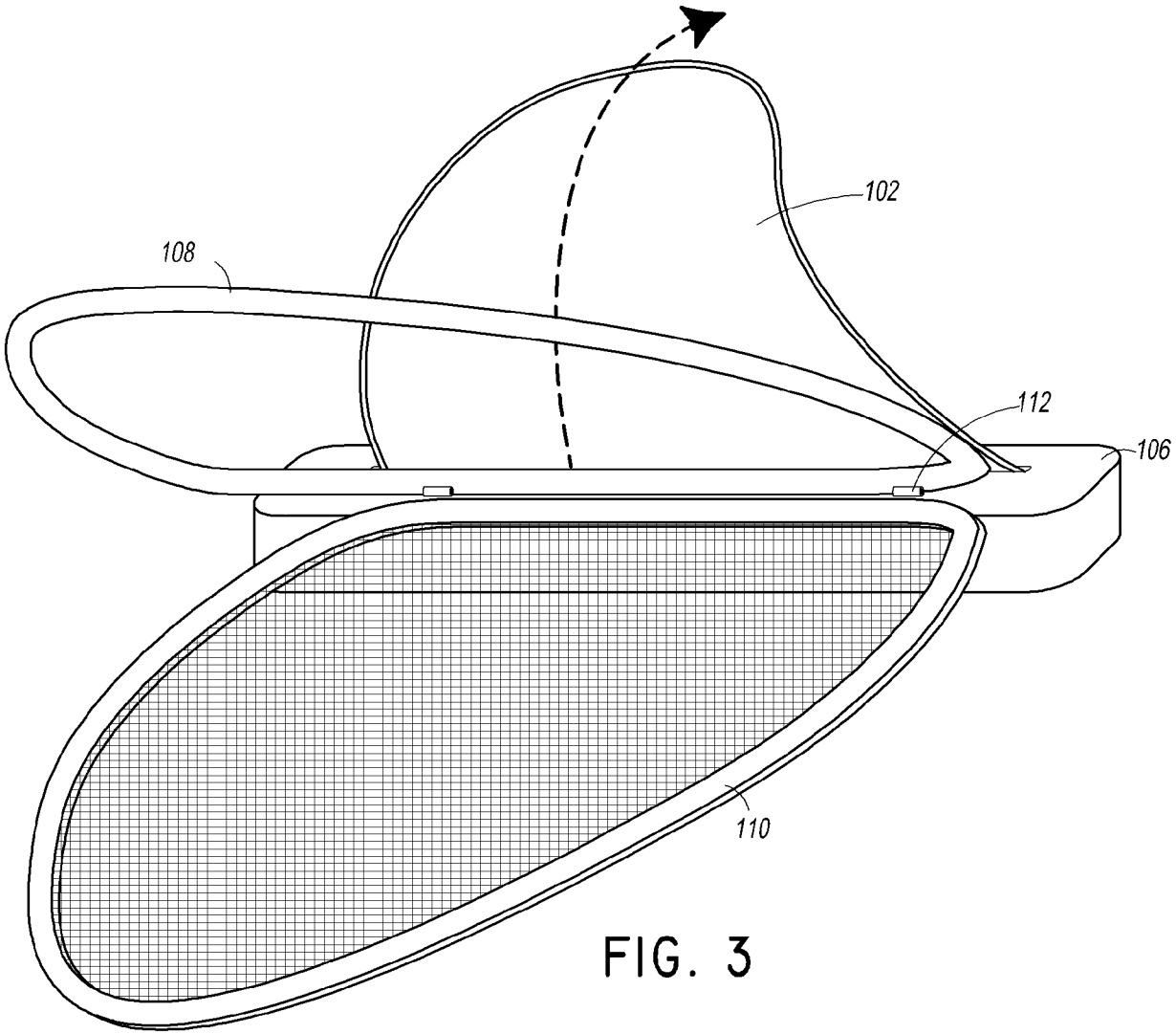
FIG. 3 illustrates an open configuration of an embodiment of a floor shield with a replacement mat.
Figure 4:
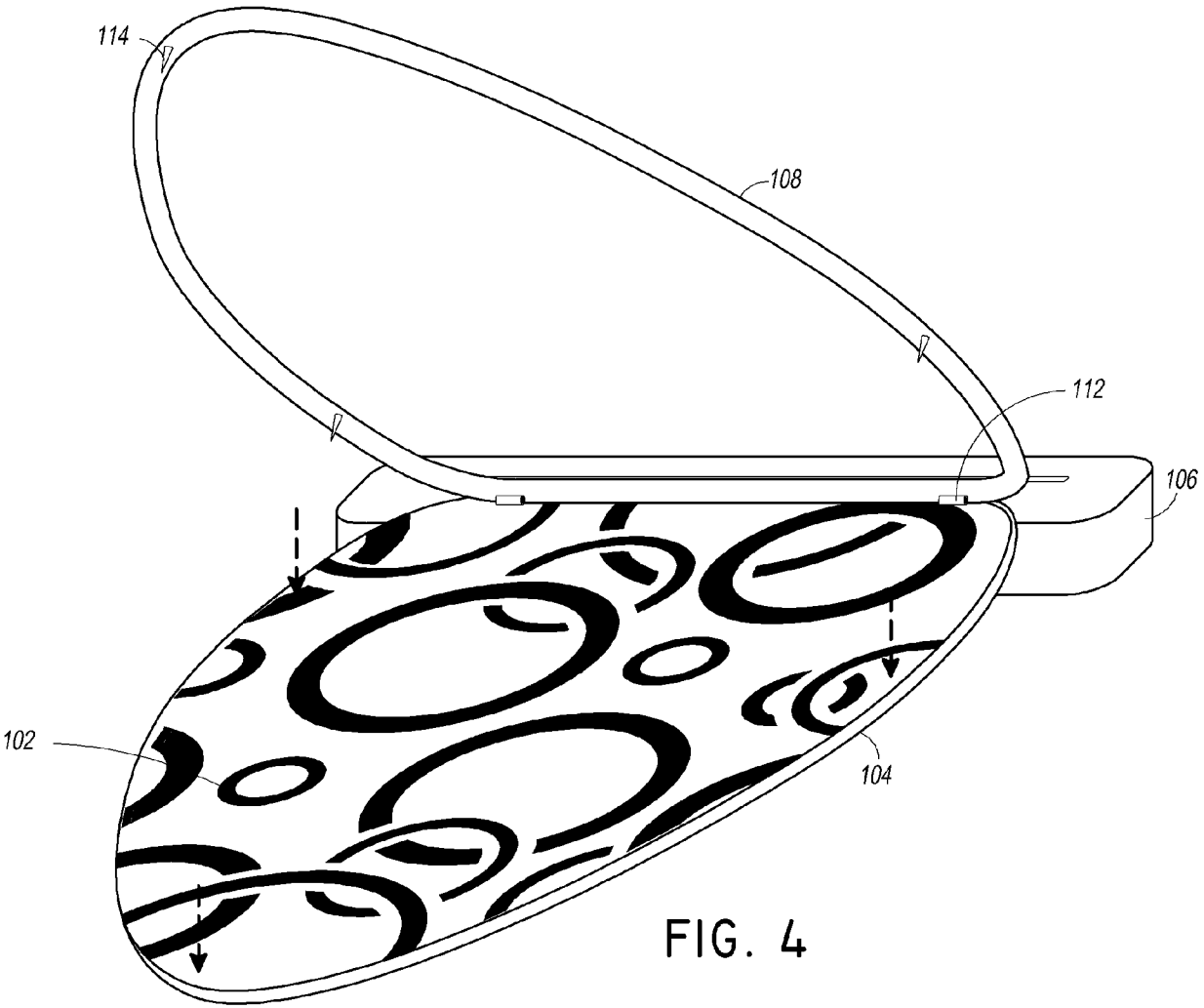
FIG. 4 illustrates an open configuration of an embodiment of a floor shield with a mat locked in place.
Figure 5:
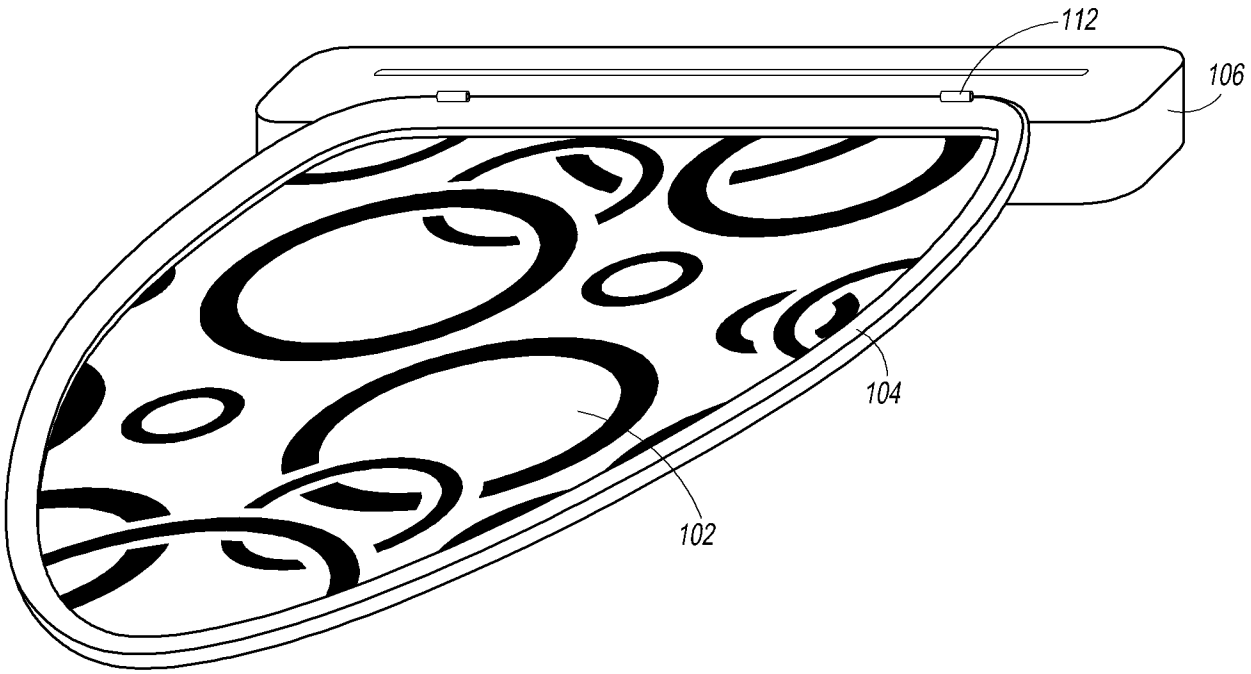
FIG. 5 illustrates a closed configuration of an embodiment of a floor shield.

FIG. 3 illustrates an embodiment of the floor shield with an open frame 104. As shown, the floor shield can have a replacement box 106 attached to the frame 104. A mat 102 can be pulled out of the replacement box 106 and can then be placed onto bottom portion 110, as shown in FIG. 4. Once the mat 102 is in the proper position, the top portion 108 can be lowered onto the top of the mat 102 so that the mat 102 is held in place between the top portion 108 and bottom portion 110, as described above. In some embodiments, the lowering of the top portion 108 onto the bottom portion 110 causes the mat 102 to be removed from the replacement box 106. In some embodiments, the mat 102 can be removed first. In some embodiments, the mat 102 can be pulled through the frame 104 in the open area 116. Once the mat 102 is within the frame 104, the mat 102 will generally not move during operation until the frame 104 is opened. FIG. 5 shows a closed configuration of an embodiment of a floor shield.

Figure 11A:
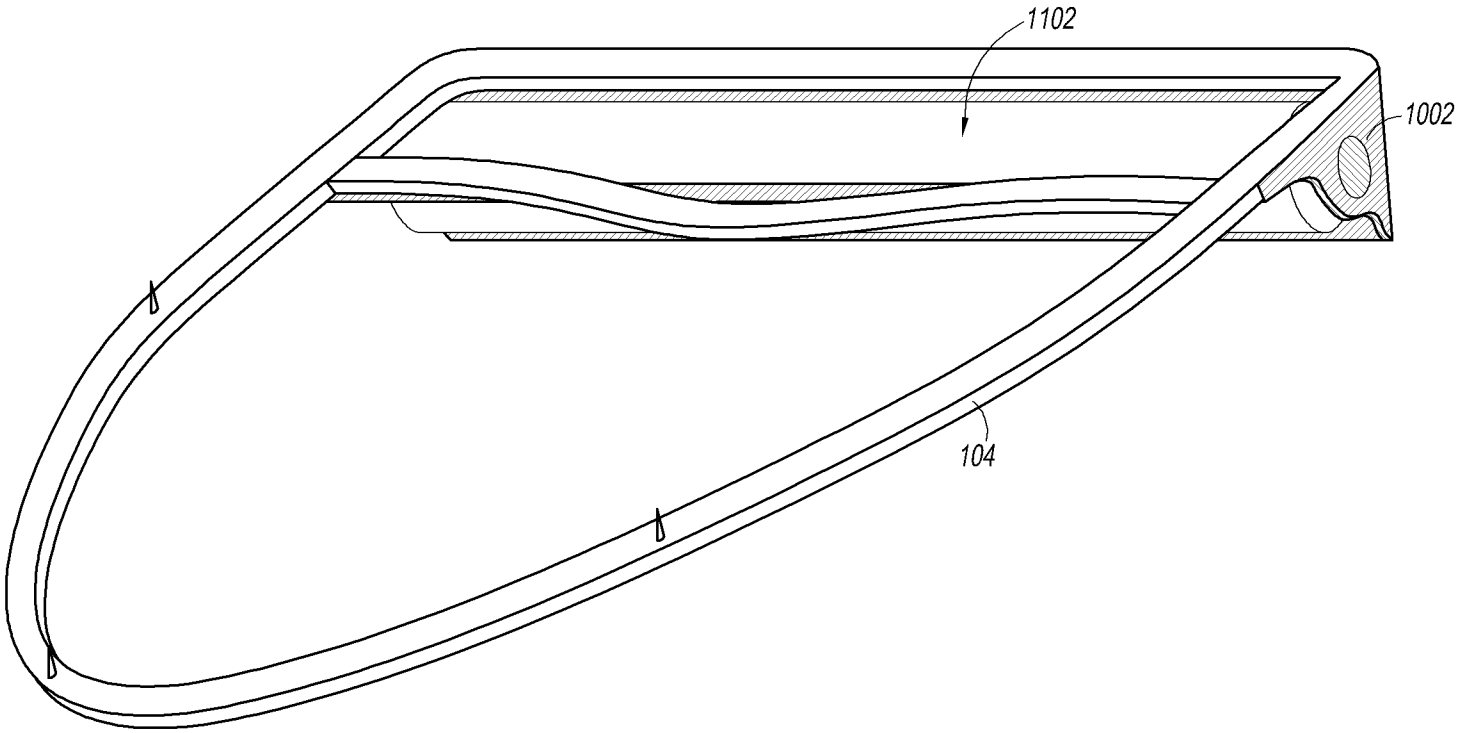
Figure 11C:
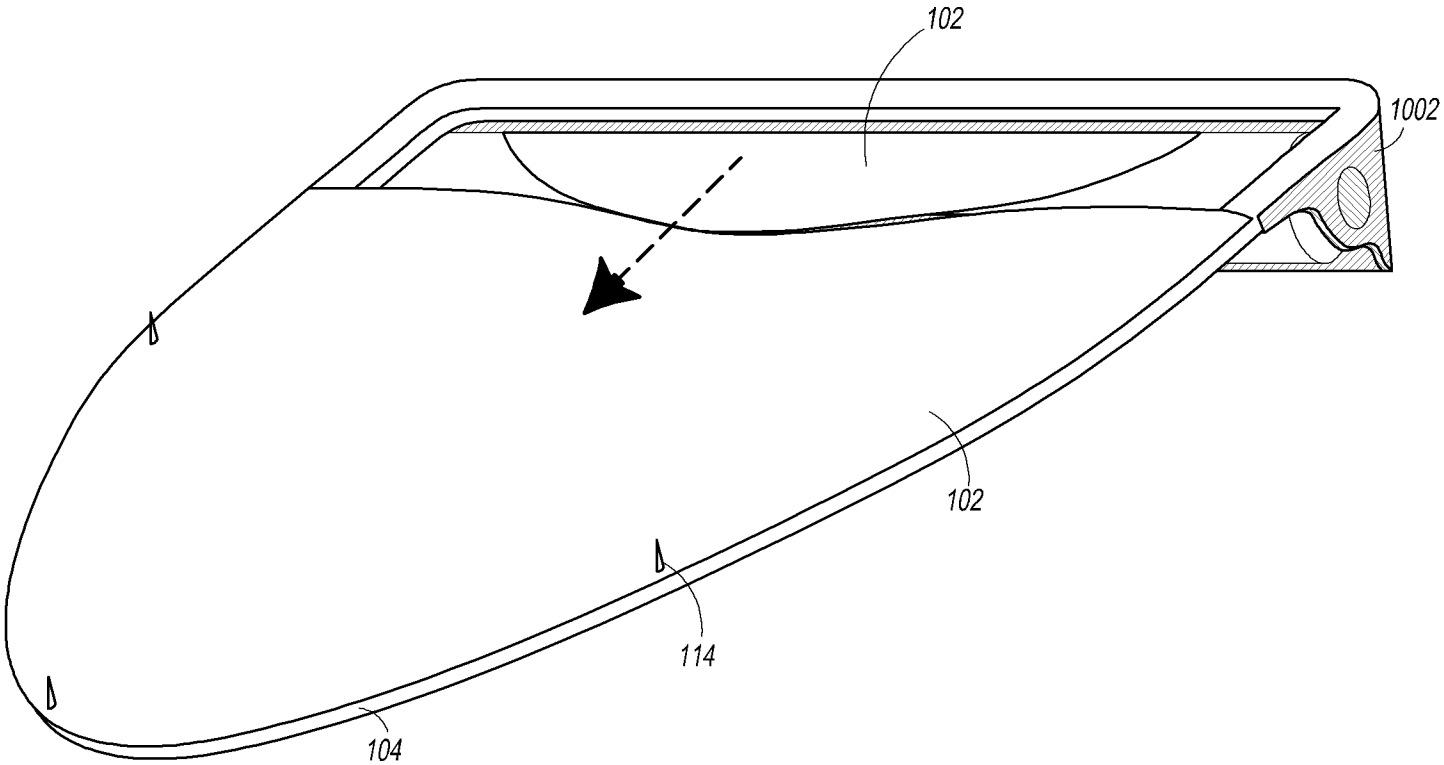

In some embodiments, the replacement box 106 can be generally shaped as a rectangular prism having an open internal cavity, though the shape does not limit the disclosure. In some embodiments, the replacement box 106 can have an open side for insertion of mats 102, though the particular side that is opened is not limiting. In some embodiments, the replacement box 106 can be fully enclosed, but can be opened to insert mats 102. Further, the replacement box 106 may have an opening, aperture, or slot in which mats 102 can be pulled out of to place onto the frame 104, such as shown in FIGS. 11A-C.

In some embodiments, the mat 102 can be made of a reusable material. For example, the mat 102 can be laundered and then reused with the floor shield. In some embodiments, the mat 102 can be linen, cloth, or other launderable material, and the type of material does not limit the disclosure. Accordingly, the reusable mat 102 can be pulled out of the replacement box 106 as described above. However, the reusable mat 102 can then be rewound into the box 106 for later use or for laundering. In some embodiments, the box 106 can be generally a towel roll where the mat 102 can be rewound. In some embodiments, the mat 102 can be manually rewound into the box 106. In some embodiments, a second box can be provided at the opposite end. In some embodiments, the box 106 (or one or both of the two boxes) can be mechanized, such as through the use of an auto-winder or auto-feed. For example, the box 106 can contain a button, switch, handle, or other advancement device that can cause the mat 102 to exit or reenter the replacement box 106, either by itself or through user force. In some embodiments, a hand-held remote can be used to move the mat 102 in and out of the box 106. In some embodiments, the advancement device can be mechanical or electrical, such as an electric motor to wind and unwind the mats 102. The type of advancement device does not limit the disclosure. In some embodiments, a user may never have to touch the mat 102.

Figure 6A:
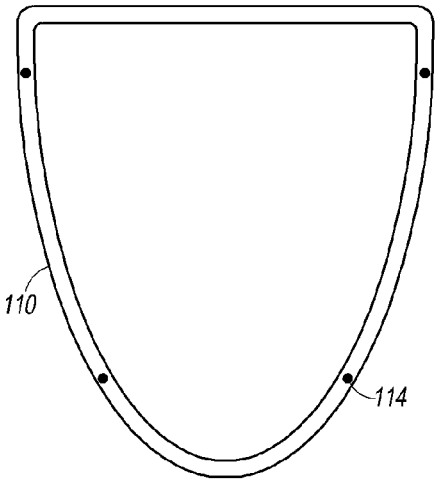
FIGS. 6A-C illustrate embodiments of a bottom portion of a frame of a floor shield with and without the mat.
Figure 6B:
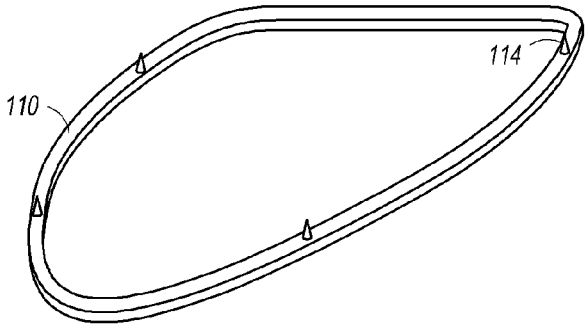
Figure 6C:
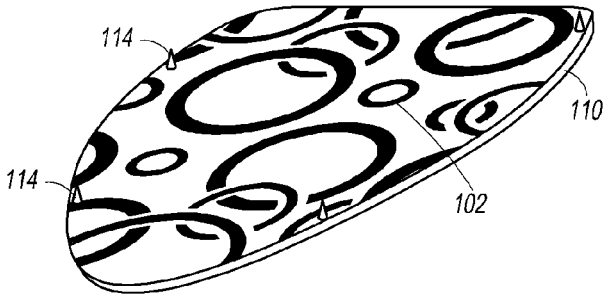

FIGS. 6A-B illustrates the bottom portion 110 by itself without a mat 102. As shown, the bottom portion 110 can contain fastening elements 114. FIG. 6C illustrates the bottom portion 110 with a mat 102 installed. As shown, the fastening elements 114 can protrude through the mat 102, though the fastening elements 114 do not protrude in some embodiments. In some embodiments, the fastening elements 114 can then insert into the top portion 108, thereby locking the mat 102 in place.

Figure 7:
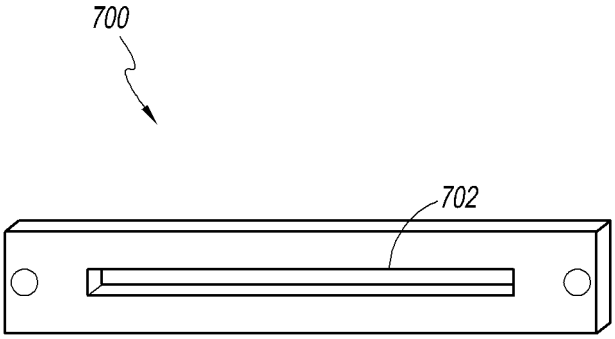
FIG. 7 illustrates an embodiment of a wall bracket for use with a floor shield.
Figure 8:
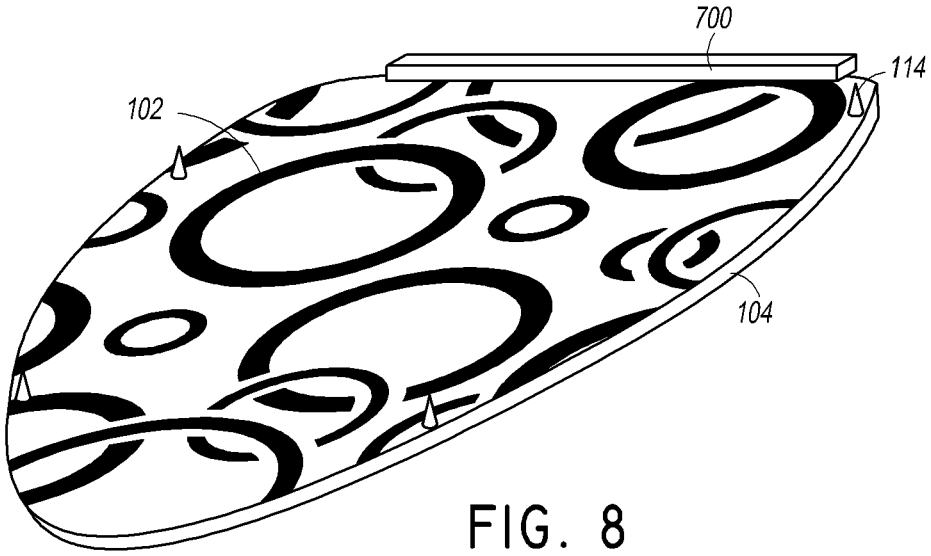
FIG. 8 illustrates an embodiment of a floor shield attached with a bracket.

FIG. 7 illustrates an embodiment of a bracket 700 that can be used to hold a floor shield onto a wall. In some embodiments, the bracket 700 and frame 704 can be integrally formed. The bracket 700 can be attached to a wall by any general attachment means, such as adhesive, magnets, Velcro, or screws, and the attachment of the bracket 700 to a wall does not limit this disclosure. In some embodiments, the bracket 700 can contain a slot 702. The slot 702 can be sized and configured to receive the floor shield. The slot 702 can include a mechanism so that when the floor shield is inserted, as shown in FIG. 8, it snaps in place or is otherwise held in place. The slot 702 can extend partially or fully across the bracket 700. The type of attachment between the floor shield and the bracket 700 does not limit this disclosure. For example, a snap mechanism or joint could be used to attach the floor shield to the bracket 700.

In some embodiments, the bracket 700 can be wider than the width of the frame 704 of the floor shield, similar to the replacement box 106 of FIG. 5. In some embodiments, the bracket 700 can smaller than the width of the frame 704 of the floor shield. In some embodiments, the bracket 700 is about 10, 11, 12, 13, 14, 15, 16, 17, 18, 19, or 20 inches wide. The size of the bracket 700 does not limit this disclosure. In some embodiments, the floor shield can be configured to slide horizontally in the slot 702 of the bracket 700, so that the horizontal position of the floor shield can be changed. In some embodiments, a replacement box 106, as described above, can be used with or instead of a bracket 700 while including similar features.

Figure 9:
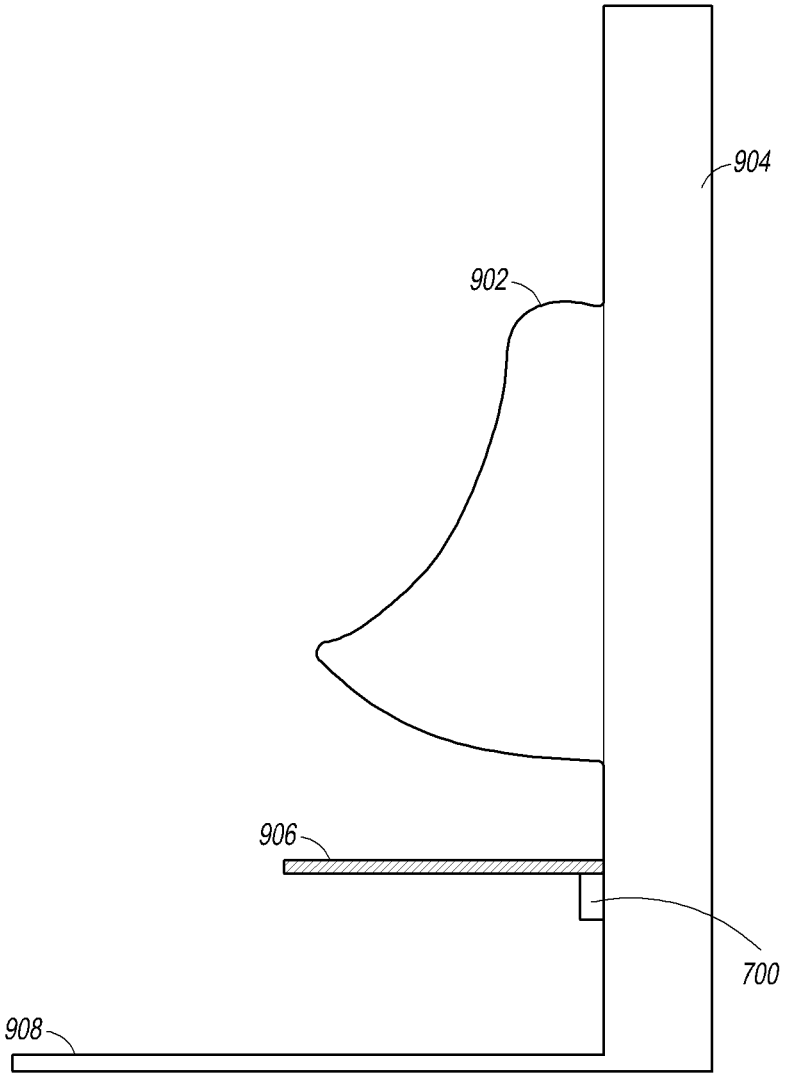
FIG. 9 illustrates an example configuration of a floor shield in a restroom.
Figure 27:
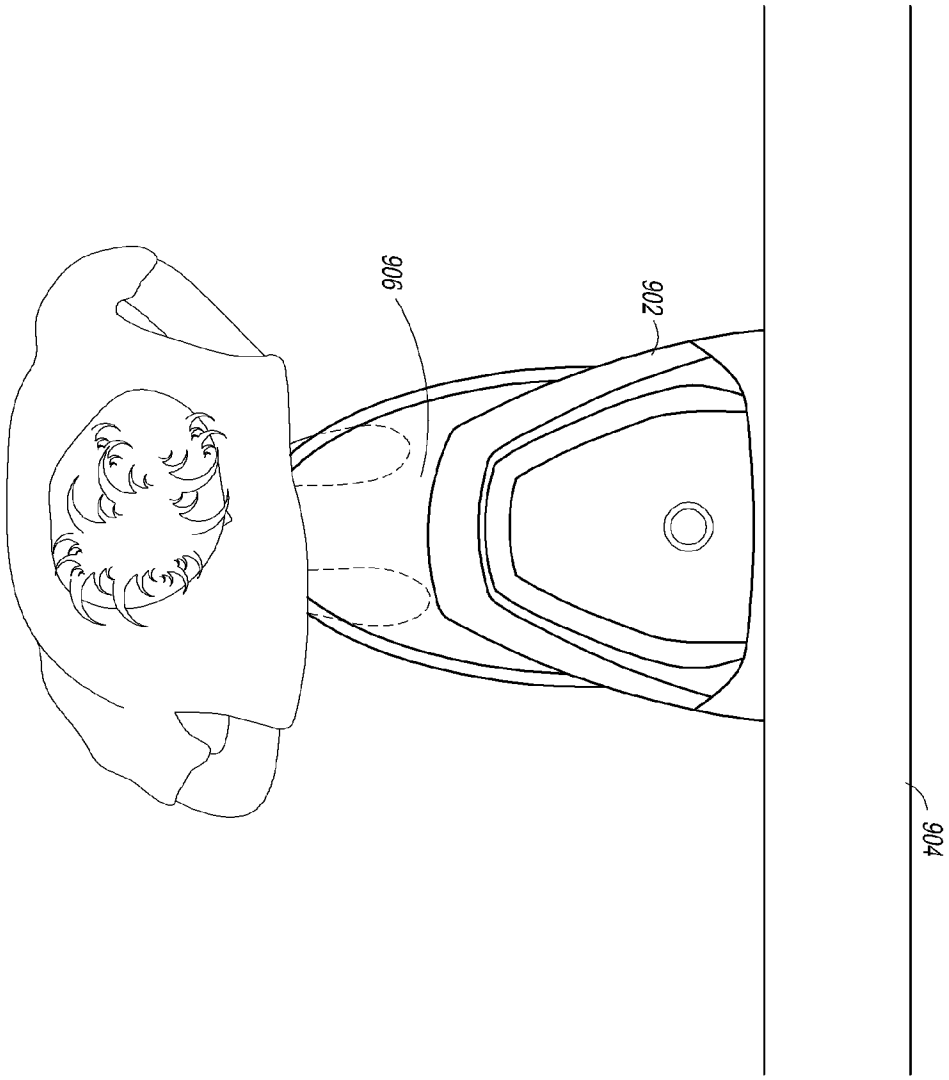
FIG. 27 illustrates a top down view of a user at a urinal with an embodiment of a floor shield.

FIG. 9 illustrates an example configuration of a urinal 902 attached to a wall 904 of a restroom using a bracket 700. As mentioned above, in some embodiments a replacement box 106 can be used with or instead of a bracket 700 to attach the floor shield 906 to the wall 904. As shown, the floor shield 906 can be attached directly below a urinal 902 above the floor 908. In some embodiments, the floor shield 906 can be about 10, 20, 30, 40, 50, 60, 70, 80, 90, or 100% bigger than the upper surface area of the urinal 902. In some embodiments, the upper surface area of the urinal 902 can be the footprint of the urinal when viewed from above, such as shown in FIG. 27. In some embodiments, the floor shield 906 can be greater than about 10, 20, 30, 40, 50, 60, 70, 80, 90, or 100% bigger than the upper surface area of the urinal 902. In some embodiments, the floor shield 906 can be about 10, 20, 30, 40, 50, 60, 70, 80, 90, or 100% bigger than a lip of the urinal 902.

In some embodiments, if there is more than one urinal in a restroom, a floor shield can be located below each of the urinals. In some embodiments, the floor shields can be all aligned at the same vertical height. In some embodiments, the floor shields can be at different vertical heights. In some embodiments, the floor shield can extend about 1, 2, 3, 4, 5, 6, 7, 8, 9, or 10 inches farther from the wall than a farthest point of the urinal it is under. In some embodiments, the floor shield can be approximately 5, 6, 7, 8, 9, 10, 11, 12, 13, 14, 15, 16, 17, 18, 19, or 20 inches off the ground. In some embodiments, the floor shield can be approximately at least 5, 7, 9, 11, 13, 15, 17, 20, 22, 24, 26, or 28 inches above the surface of the floor. In some embodiments, the floor shield can be located at a distance above the ground so that a user can put their shoes underneath the shield. The floor shield can be easily removable from the wall of the restroom, or can be integrally formed with the wall. In some embodiments, the entire floor shield can be disposable.

Figure 10A:
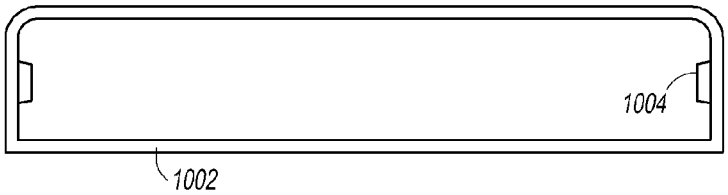
FIGS. 10A-C illustrate an embodiment of a bracket having replacement mats for a floor shield.

In some embodiments, a roll holder can be used with a floor shield for replacement of mats 102. FIG. 10A illustrates an embodiment of a roll holder 1002. As shown, the holder 1002 can be shaped generally like a paper towel dispenser. In some embodiments, the holder 1002 can hold 5, 10, 15, 20, 25, 30, 35, or 40 mats 102. In some embodiments, the holder 1002 can hold more than one roll of mats 102, and can include a mechanism to change rolls. In some embodiments, the holder 1002 can hold greater than 5, 10, 15, 20, 25, 30, 35, or 40 mats 102. The amount of mats 102 held by the holder 1002 does not limit the disclosure. In some embodiments, the holder 1002 can have a pair of posts/bosses/protrusions 1004 at opposite ends of the holder 1002 that can be configured to insert into a roll of replacement mats 102, which can allow the roll of replacement mats 102 to rotate and be pulled out by a user. In some embodiments, the replacement mats 102 can have length, width, and surface areas similar to those described in detail above. However, the configuration of the internal structure of the roll holder 1002 to hold replacement rolls 102 does not limit this disclosure, and other configuration, such as tabs, clasps, and other structures can be used.

Figure 10B:
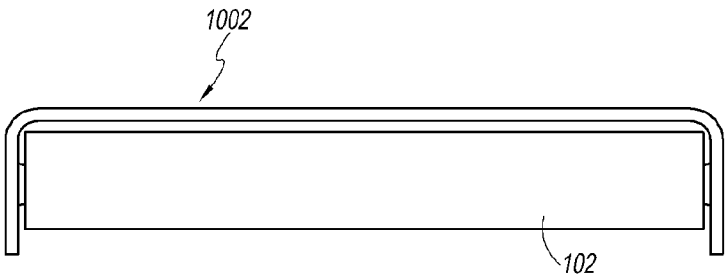

FIG. 10B illustrates an embodiment of a roll holder 1002 with a refill of replacement mats 102 installed. In some embodiments, the holder 1002 can be at least partially flexible to accommodate the insertion of the refill. In some embodiments, the holder 1002 can be rigid. In some embodiments, at least one of the posts 1004 can be removed to allow for insertion of the replacement mats 102.

Figure 10C:
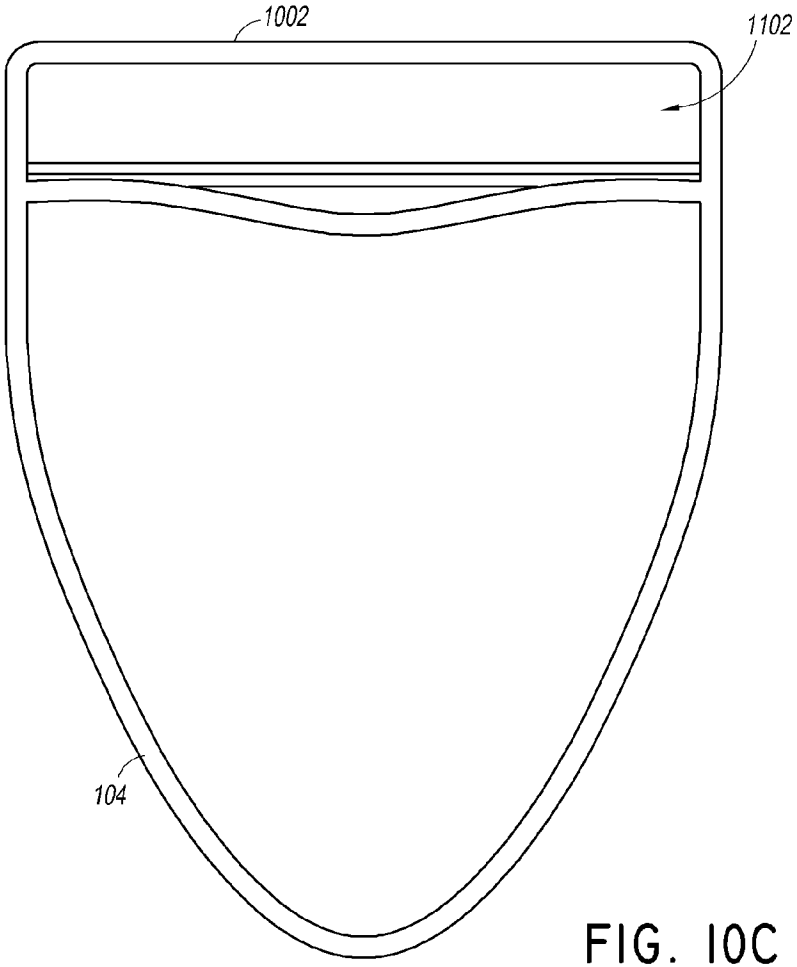

FIG. 10C illustrates a top down view of a holder 1002 installed with a floor shield. In some embodiments, the holder 1002 can be configured to attach to a wall, such as shown in FIG. 9. In some embodiments, a roll of mats 102 can be located outside the holder 1002. For example, the roll can be located above or below the holder 1002. In some embodiments, the roll can be located about 1, 2, 3, 4, 5, 6, 7, 8, 9, or 10 inches from a wall. In some embodiments, the roll of mats 102 can be loaded from the side, bottom, or top of the holder 1002.

FIG. 11A illustrates angled perspective view of a floor shield wherein the frame 104 is attached to a holder 1002. As shown, in some embodiments only the bottom portion 110 of the frame 104 can be attached to the holder 1002, and they can be removable or integrally formed. In some embodiments, a top portion 108 is used as well, as described in detail above. In some embodiments, the frame 104 only has the bottom portion 110. In some embodiments, the frame 104 can have an opening 1102 that can allow for mats 102 to be pulled through. Accordingly, in some embodiments the frame 104 can lay directly on top of the holder 1002.

In some embodiments, the frame 104 can be flexibly attached to the holder 1002. Therefore, if excess force was exerted on the frame 104, for example through a kick or step, the frame 104 may be moved but the holder 1002 may not be removed from the wall. Afterwards, the frame 104 may be reattached to the holder 1002. The attachment between the frame 104 and the holder 1002 does not limit this disclosure, and any attachment, such as adhesive or mechanical fastening, can be used. In some embodiments, the frame 104 can be easily removable from the holder 1002, and thus can be easily disposed of while the holder 1002 remains. In some embodiments, the holder 1002 can contain the opening 1102, and the frame 104 can attach to the front of the holder 1002. In some embodiments, there is no opening 1102 and a replacement mat 102 can be pulled out and placed in the frame 104, as described above. In some embodiments, the holder 1002 can contain an opening on the top so a user can see if more replacement mats 102 should be added.

FIG. 11B illustrates a replacement mat 102 being pulled out of the holder 1002 and on to the bottom portion 110 of the frame 104. As shown, the mat 102 can be pulled through the opening 1102 that can be located either on the holder 1002 or frame 104.

FIG. 11C illustrates a mat 102 attached to an embodiment of a floor shield. As discussed above, the mat 102 can be attached through fastening elements 114. As shown in the figure, in some embodiments, the next refill mat 102 can be attached to the rear of the mat 102 that is attached to the frame 104. Accordingly, when the mat 102 on the frame is removed, the next mat 102 can be pulled into place. In some embodiments, the next mat 102 is not attached to the previous mat 102. In some embodiments, the holder 1002 can contain a lever or grip to turn the replacement mats 102, thus positioning the next mat 102 for a user to grab and pull out.

Figure 12A:
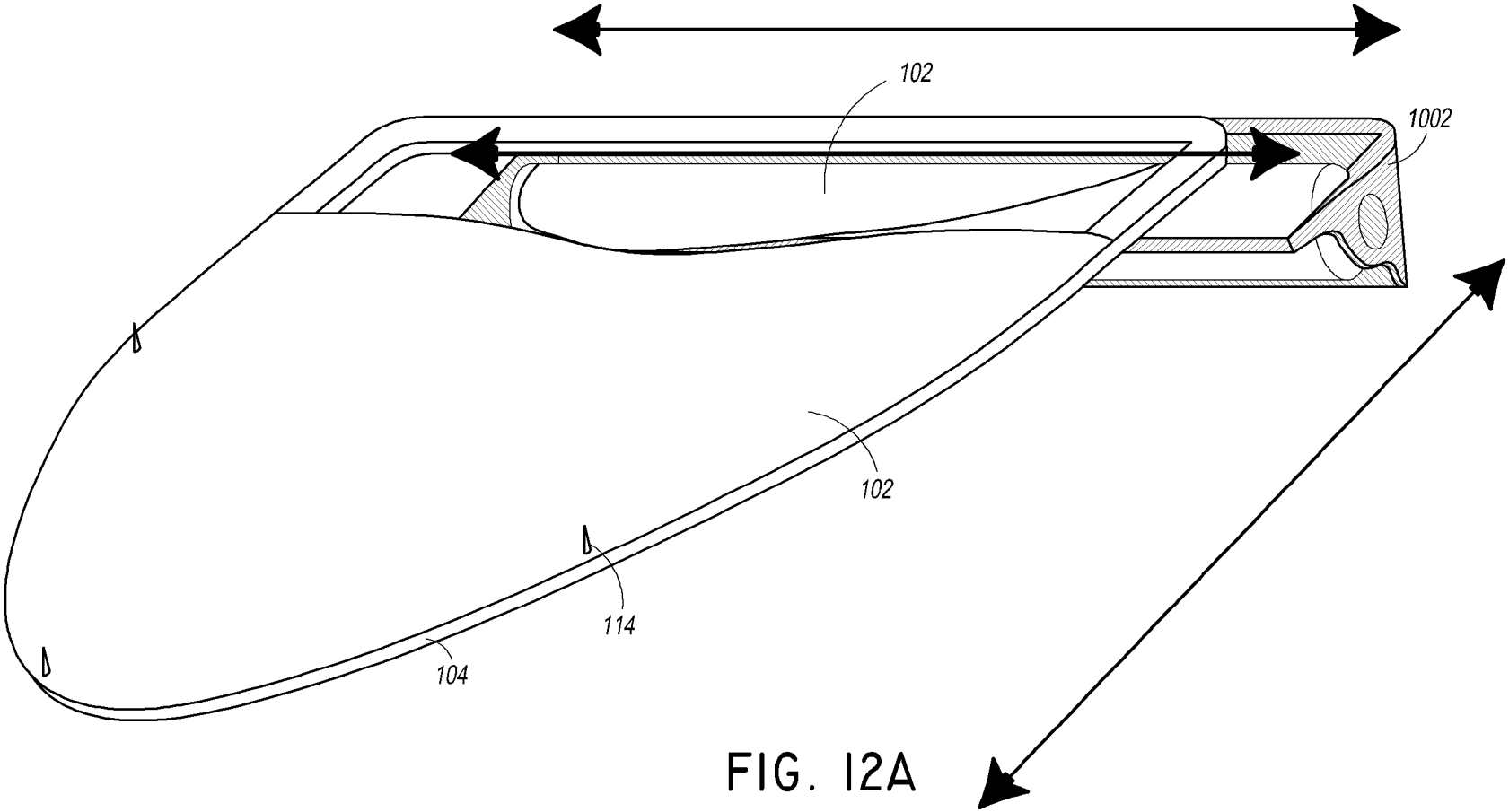
FIGS. 12A-D illustrate configurations of embodiments of a floor shield.

FIG. 12A illustrates an embodiment of a floor shield wherein the shield is configured to move with relation to the holder 1002. This movement can allow for ease of installation. For example, the shield can be attached to the top of the holder 1002 in a slot, and can therefore move horizontally through the slot. This can allow the shield to move left or right while the holder 1002 remains in position, while still maintaining the ability to pull the replacement mat 102 from the holder 1002. In some embodiments, other configurations than a slot can be used for horizontal mobility, and the configuration does not limit the disclosure.

In some embodiments, the floor shield can also move on the holder 1002 to and away from the holder 1002, and therefore the wall. This can be advantageous as different urinals do not always extend the same distance from the wall. For example, the holder 1002 can have at least one guide rail extending perpendicular for the floor shield to move with. In some embodiments, the guide rail can be configured to have sections which lock the floor shield in place. In some embodiments, the shield can rest on top of the guide rails 1006, as shown in FIG. 12D. In some embodiments, the guide rails 1006 can insert into the frame 104 of the floor shield, so that the rails fit within the floor shield. In some embodiments, the guide rails 1006 can be configured so that the floor shield has about 1, 2, 3, 4, 5, or 6 inches of movement away from the holder 1002. In some embodiments, the guide rails 1006 can be configured so that the floor shield has less than about 1, 2, 3, 4, 5, or 6 inches of movement away from the holder 1002. In some embodiments, the guide rails 1006 can be configured so that the floor shield has greater than about 1, 2, 3, 4, 5, or 6 inches of movement away from the holder 1002. In some embodiments, the frame 104 can be configured to move parallel with the holder 1002 as well as perpendicular to the holder 1002 at the same time. In some embodiments, the floor shield can have a similar configuration of guide rails that allows the floor shield to move vertically. In some embodiments, a different mechanism for moving horizontally and/or vertically can be used, and the mechanism does not limit the disclosure. In some embodiments, the floor shield can be configured to move both vertically and horizontally.

Figure 12B:
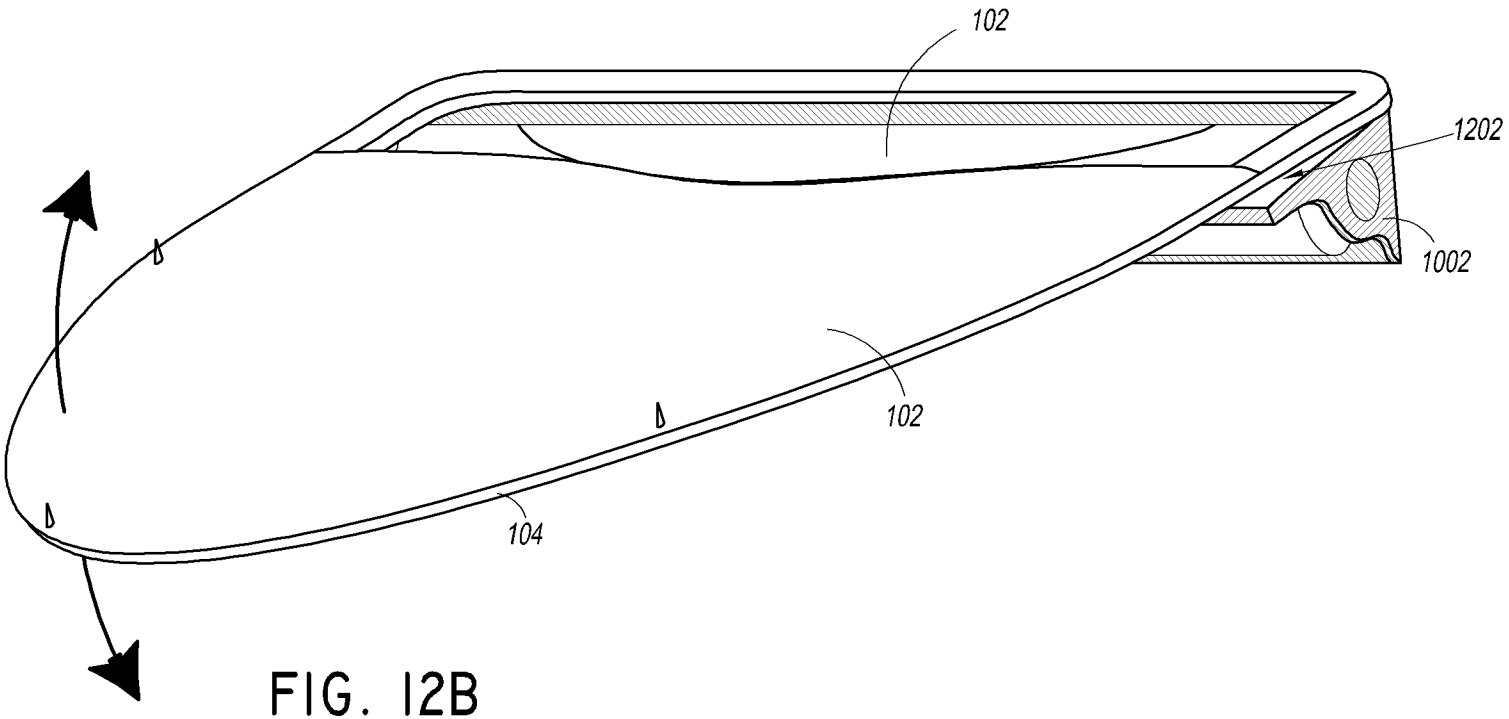
Figure 12C:
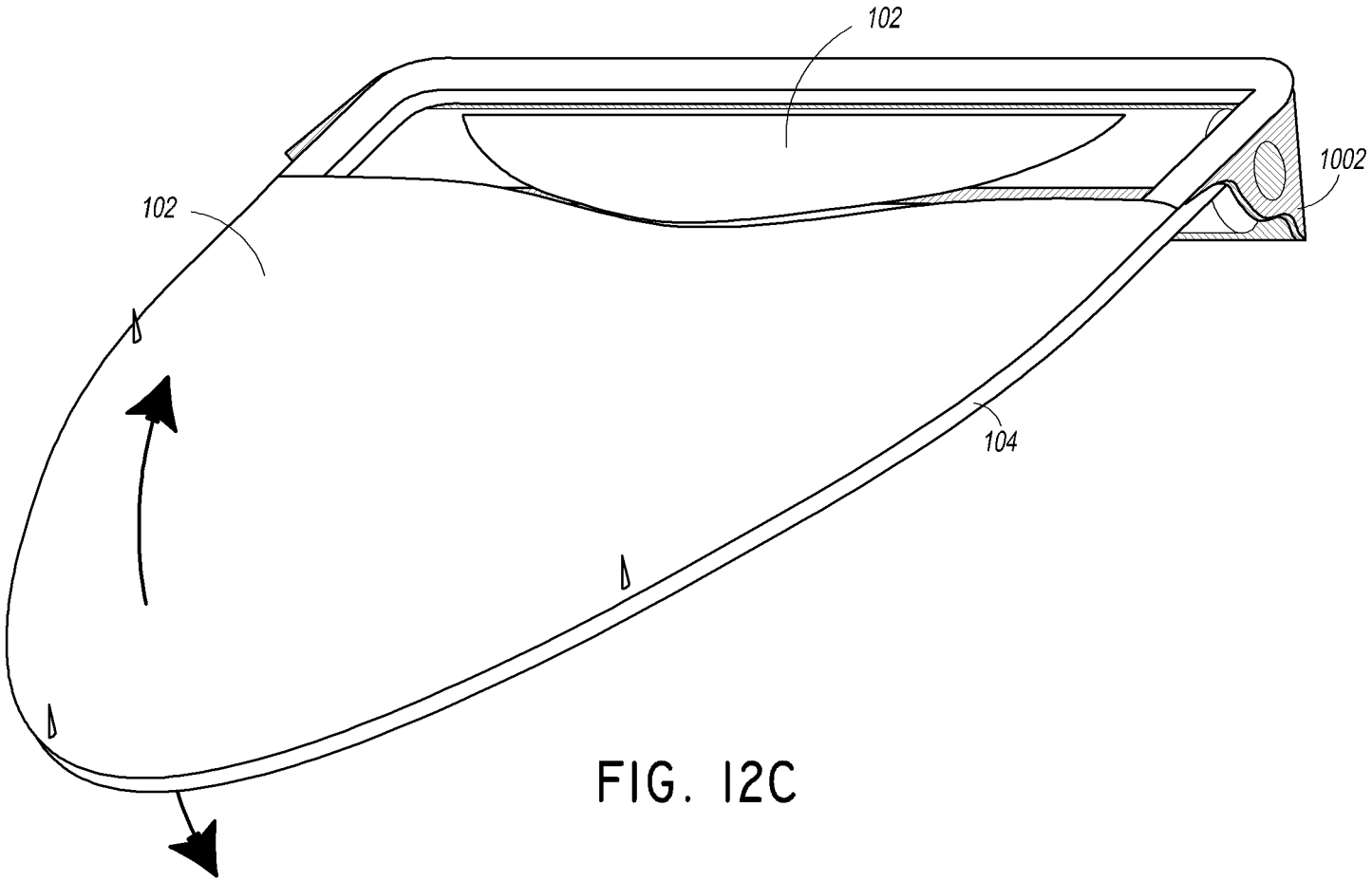
Figure 12D:
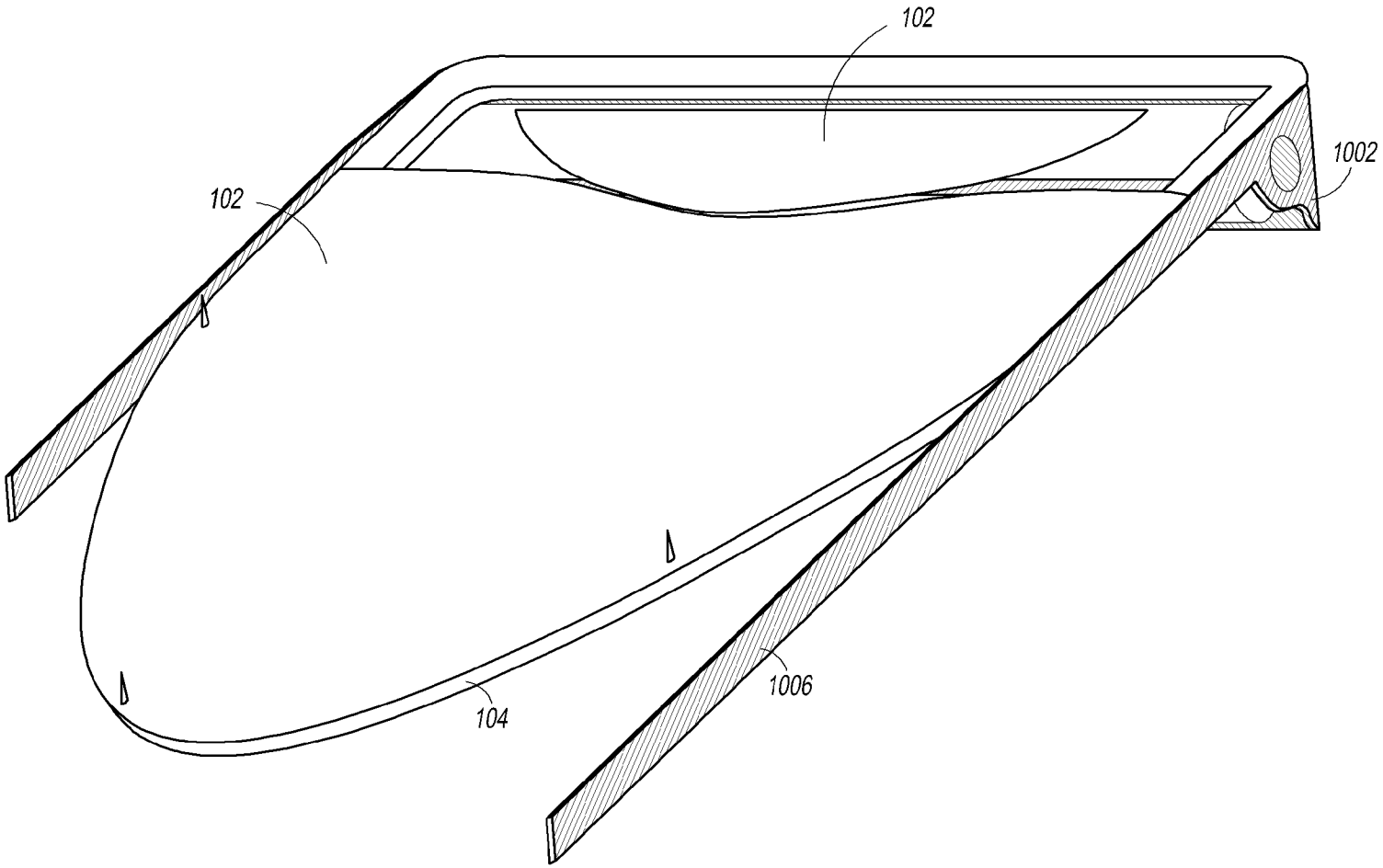

FIGS. 12B-C illustrate the flexibility of certain embodiments of a floor shield. In some embodiments, the shield can be angled upwards or downwards from its original position. The shield can be angled upwards or downwards without any damage to the shield or the holder 1002. In some embodiments, the frame and/or holder can be made of flexible materials so that they can be angled and return to their original position. In some embodiments, there can be some clearance 1202 between the shield and the holder 1002, and therefore a user can angle the shield and it can remain in the new position. In some embodiments, the shield can be at least partially rotated in the holder 1002 as well.

In some embodiments, the shield can be configured have approximately 1, 2, 3, 4, 5, 6, 7, 8, 9, or 10 inches from top angled position to bottom angled position. In some embodiments, the shield can be configured have greater than approximately 1, 2, 3, 4, 5, 6, 7, 8, 9, or 10 inches from top angled position to bottom angled position.

Figure 13:
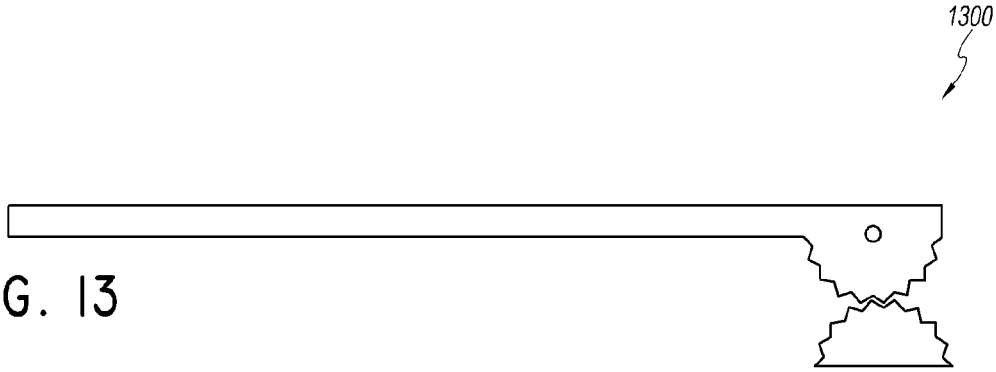
FIG. 13 illustrates an embodiment of a gear system which can be used in a floor shield.

In some embodiments, a gear system 1300 can be used to allow for the angling of the shield, as shown in FIG. 13. The gear system 1300 can be used to lock the shield in place at a chosen angled position. The gear system 1300 can have approximately 10, 20, 30, 40, 50, 60, 70, 80, 90, 100, 110, 120, 130, 140, 150, 160, 170, or 180 degrees of motion. The gear system 1300 can have greater than approximately 10, 20, 30, 40, 50, 60, 70, 80, 90, 100, 110, 120, 130, 140, 150, 160, 170, or 180 degrees of motion. However, the angling system does not limit the disclosure.

In some embodiments, an air freshener, fragrance, or other scented product and/or substance can be incorporated into the floor shield. In some embodiments, the freshener may be a part of the material used in the construction of the floor shield. In some embodiments, the floor shield may be at least partially made of a material that is loaded with a fragrance material. In some embodiments, the freshener can be used after the floor shield is made, for example through a liquid spray. The spray could then dry onto the parts of the floor shield, thereby giving the fragrance. The type of freshener does not limit the disclosure. The materials used may be polymers, such as both thermoplastic and thermoset polymers. Some examples of polymers that may be suitable are synthetic resins. Some particular examples of thermoplastic resins that may be suitable for include ethylene vinyl acetate (EVA), polyvinyl chloride (PVC), polyethylene (PE), polypropylene (PP), polymethylpentene (NIPX), ethylene-(meth)acrylate ester copolymers, acrylic-type vinyl resins such as polymethyl methacrylate (PMMA), styrene-type vinyl resins such as polystyrene (PS), acrylonitrile-butadiene-styrene (ABS) copolymers, acrylonitrile-styrene (AS) copolymers, other vinyl resins such as polyvinyl acetate, polyvinylidene chloride (PVDC), polyvinyl alcohol (PVA), and polytetrafluoroethylene (PTFE), polyester resins such as polybutylene terephthalate (PBT) and polyethylene terephthalate (PET), polyamide resins such as nylon 6, nylon 66, nylon 610, nylon 11, and nylon 12, polyoxyalkylene resins such as polyacetal (POM), and other thermoplastic resins such as polycarbonates (PC), modified polyphenylene ethers (modified PPE), polyvinyl acetates (PVAC), polysulfones (PSU), polyethersulfones (PES), polyphenylene sulfides (PPS), polyarylates (PAR), polyamideimides (pAI), polyetherimides (PEI), polyetheretherketones (PEEK), polyimides (PI), as well as copolymers of the preceding. Combinations of different plastics can also be used. Further, different plastics can be used to produce different portions of the floor shield. However, the particular material does not limit the disclosure.

The freshener may be incorporated into different portions of the floor shield. For example, in some embodiments the freshener can be incorporated into the mats 102. In some embodiments, the freshener can be incorporated into any of the portions of the frame 104. In some embodiments, the freshener can be incorporated into the holder 1002. In some embodiments, the freshener can be located in multiple, or all, parts of the floor shield. The location of the freshener does not limit the disclosure.

In some embodiments, the material that can be used to form the urinal screen may be capable of resisting the harsh environment experienced on the restroom floor, which may contain urine, waste products, cleaning solutions, and other undesirable liquids (e.g., contaminants such as paint thinner, paint, motor oil, or chemicals that may be poured into a urinal.) In some embodiments, the material of the floor shield may be designed to maintain a near-pristine condition (evident after a water rinse or basic cleaning operation), without discernable wear for a long period of time, or large amount of uses and flushes. Thus, it may be said that the floor shield may resist damage or alteration due to the environmental conditions within a restroom. In some embodiments, the material of the floor shield, such as the frame 104 or mat 102 may be designed to last a certain amount of time, level or amount of use, or number of flushes, without exhibiting any wear (e.g., tearing, discoloring, disintegration, deformation, shrinkage, loss of scent) for that specified time/usage/period. For example: the lasting time may be 30 days, 60 days, 90 days, 6 months, or perhaps 1 year; the level or amount of use may be 100, 500, 1000, 5000, 10000, or perhaps 50000 uses (e.g., urinations); the number of flushes may be 100, 500, 1000, 5000, 10000, or perhaps 50000 flushes. In other embodiments, the material of the floor shield may be designed to purposefully start exhibiting wear after the aforementioned predetermined amount of time/usage/period, such that the portions of the floor shield can start to tear, discolor, disintegrate, deform, shrink, or lose scent, which may alert maintenance personnel to replace portions of the floor shield, such as the mat 102.

Figure 14:
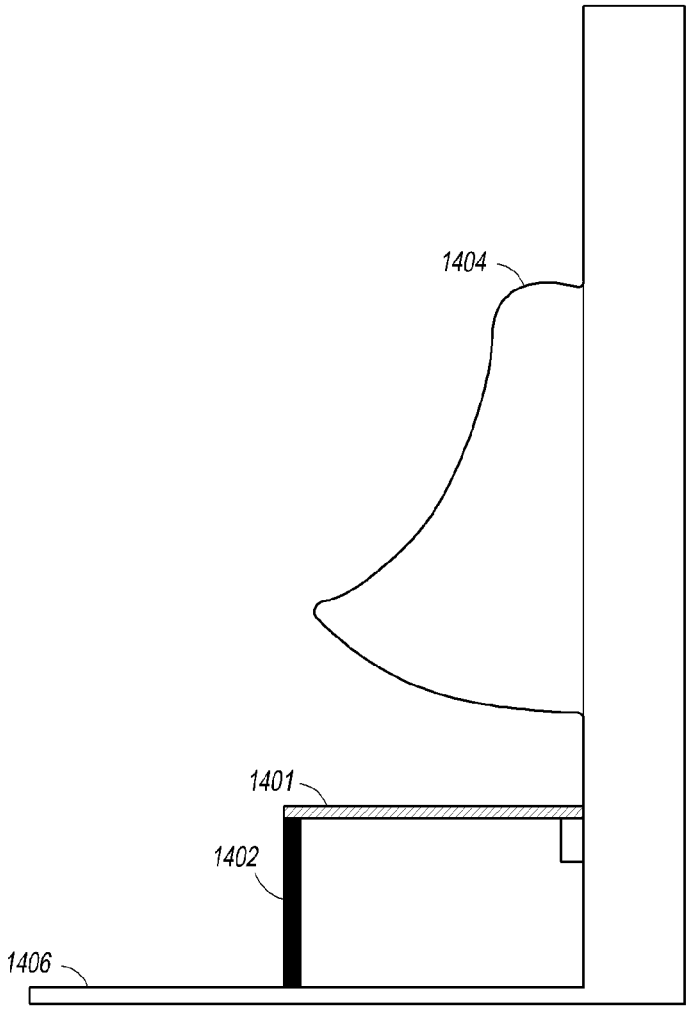
FIG. 14 illustrates an embodiment of a floor shield having a support leg.

FIG. 14 shows an embodiment of a floor shield having a support structure 1402 below a urinal 1404. The support structure 1402 can give enhanced strength to the floor shield. Further, it can prevent breakage if excess pressure is put on the top of the floor shield. In some embodiments, the support structure 1402 can extend from the bottom portion 110 of the floor shield. In some embodiments, the support structure 1402 can be located on an end of the floor shield opposite the wall, as shown in FIG. 14. In some embodiments, the support structure 1402 can be configured to rest against a floor 1406 when the floor shield is set up. In some embodiments, the support structure 1402 can be generally rectangular, circular, or triangular in cross section, though the shape of the support structure 1402 does not limit the disclosure. In some embodiments, 1, 2, or 3 support structures 1402 can be used. In some embodiments, the support structure 1402 can be configured to be rotated or moved on the floor shield. In some embodiments, the support structure 1402 can be configured to be removed and replaced. In some embodiments, the support structure 1402 may attach to the shield at a hinge, and the support structure 1402 can be folded into the floor shield for ease of transportation.

Figure 15A:
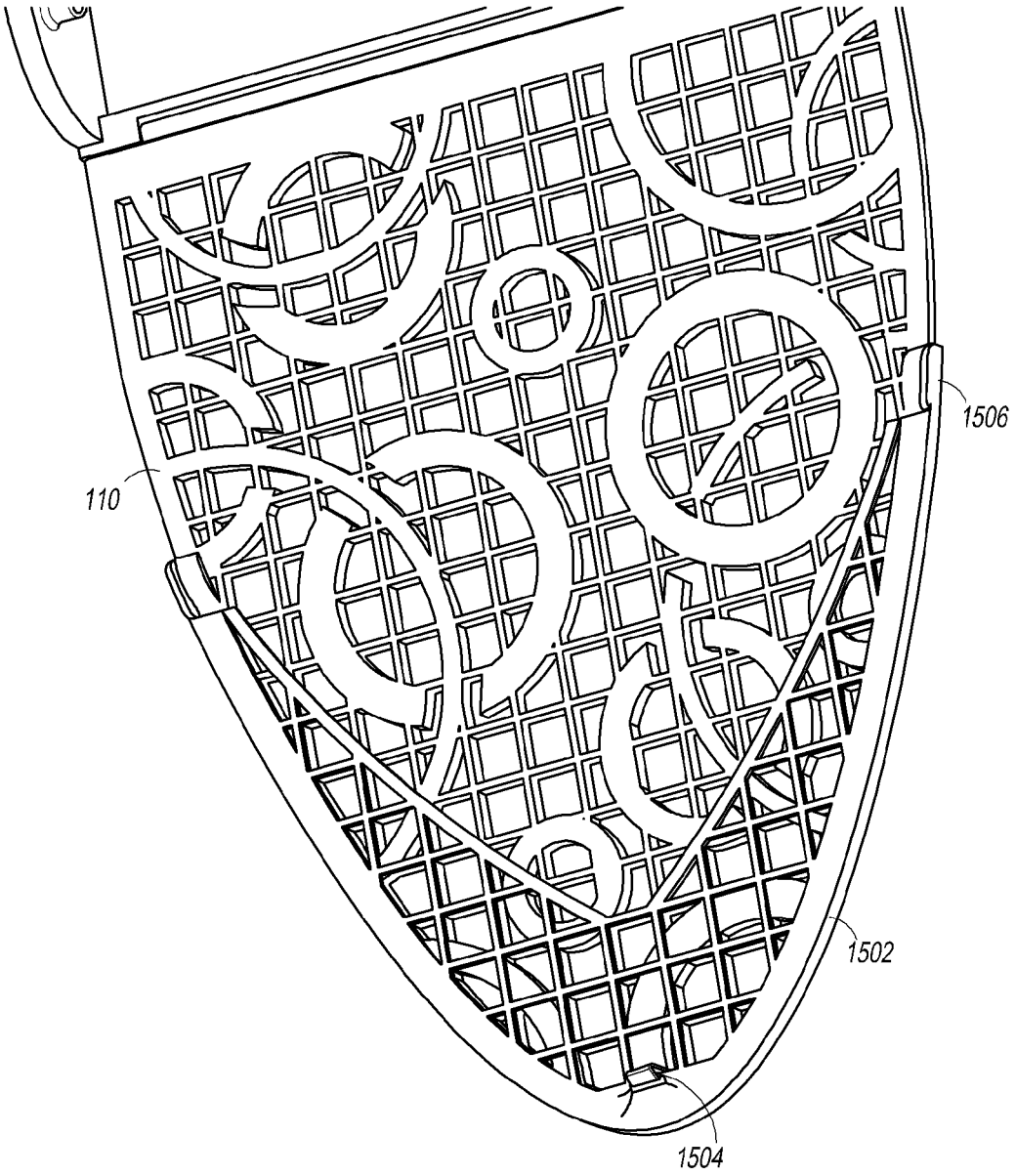
FIGS. 15A-C illustrate an embodiment of a retainer for a floor shield.
Figure 15B:
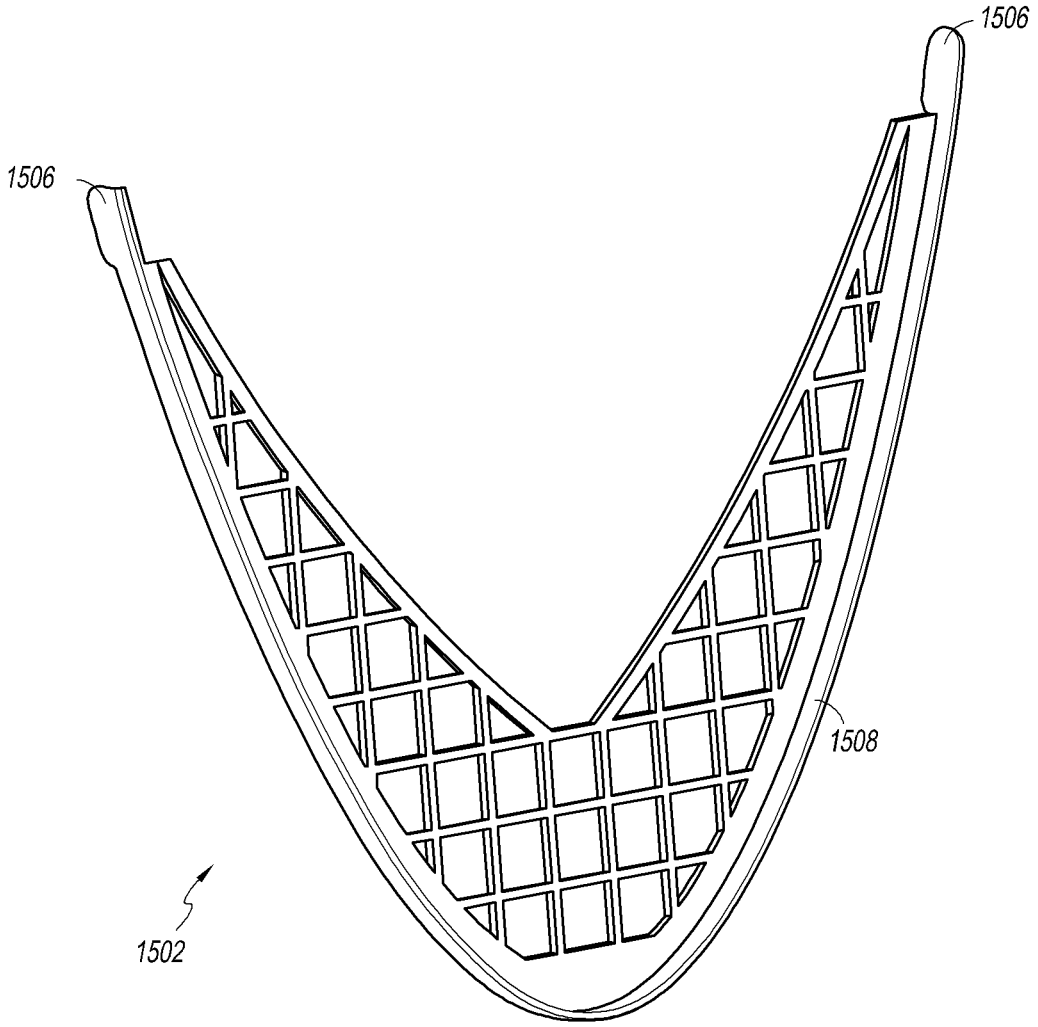
Figure 15C:
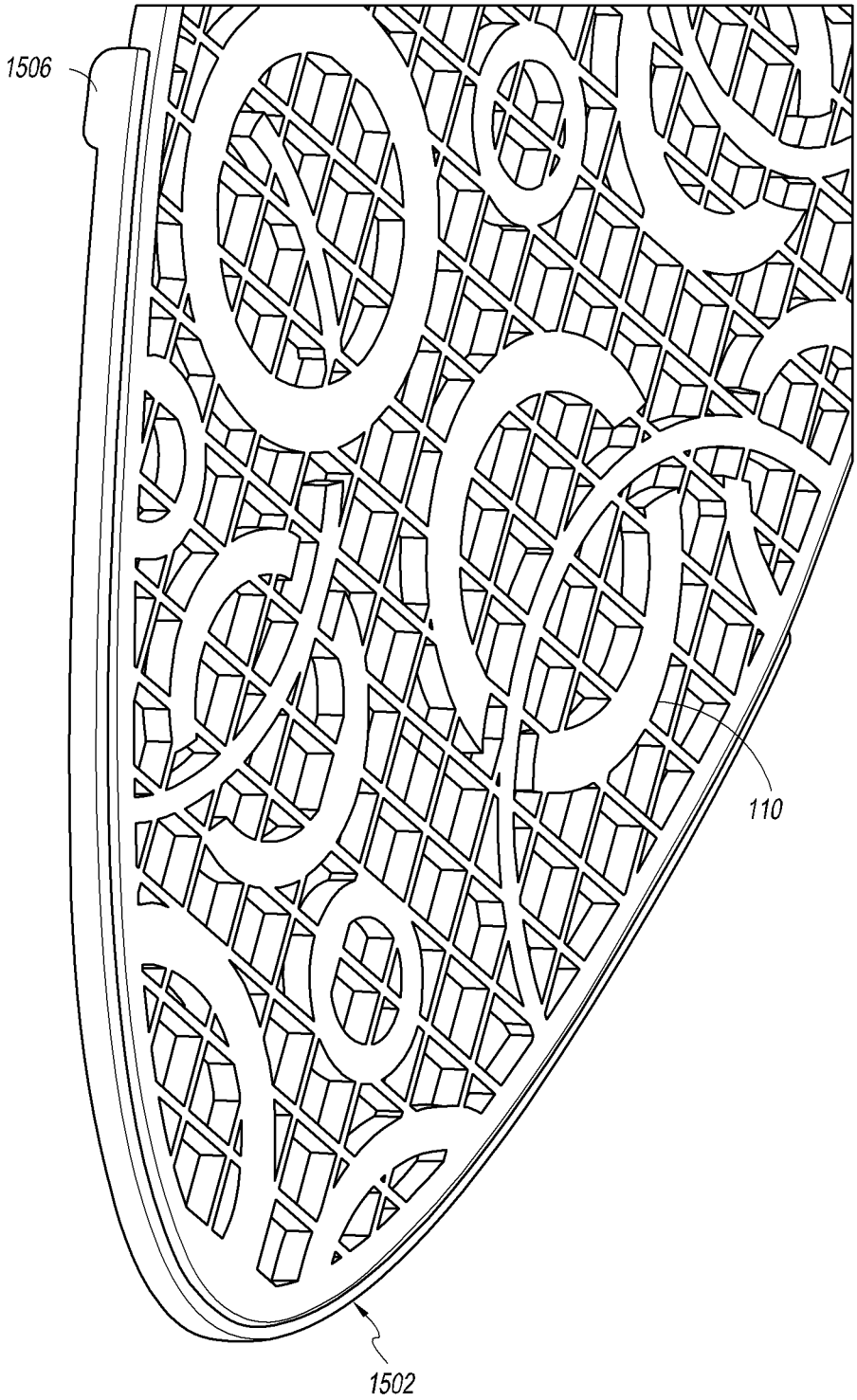

FIGS. 15A-C illustrate an embodiment of a floor shield having a retainer 1502. In some embodiments, the retainer 1502 can be used to releasably retain the mat 102 to the bottom portion 110 instead of using a top portion 108. However, in some embodiments, the top portion 108 can be used in conjunction with the retainer 1502. In some embodiments, the retainer can be located on either the top or bottom of the bottom portion 110.

The mat 102 can be pulled over the top of the bottom portion 110 and then at least partially onto the bottom of the bottom portion 110 when the retainer 1502 is open. The retainer 1502 can then closed over a portion of the mat 102 underneath the bottom portion 110, thereby holding the mat 102 in place and providing a pleasing appearance. In some embodiments, as shown in FIG. 15A, a latch 1504 can be used to keep the retainer 1502 closed, though other mechanisms can be used as well. In some embodiments, the retainer 1502 can be rotatably attached to the bottom portion 110 through the use of at least one hinge 1506.

FIG. 15B illustrates an embodiment of a retainer 1502 by itself. As shown, the retainer 1502 can have a generally v-shape. In some embodiments, the retainer 1502 can have a generally semicircle shape (e.g., the retainer 1502 extends completely across between hinges 1506), and the shape of the retainer 1502 does not limit the disclosure. As shown, the retainer 1502 can have outer walls 1508 configured to fit against the outside of the bottom portion 110, thereby retaining a mat 102 between the bottom portion 110, the walls 1508, and the base 1510 of the retainer. FIG. 15C shows the closed configuration of a retainer 1502 from a top viewpoint. In some embodiments, the retainer 1502 can be flexible.

Figure 16:
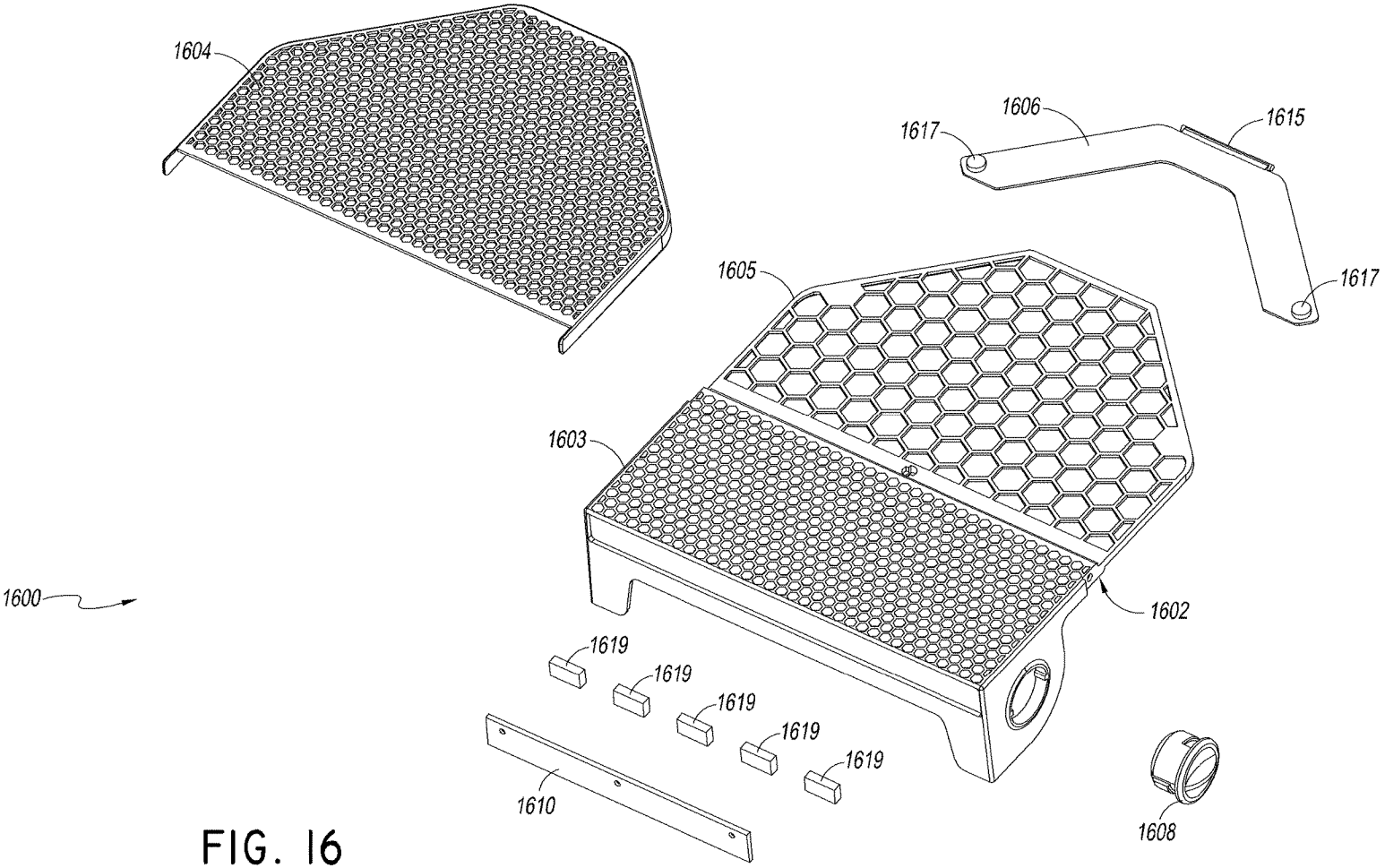
FIG. 16 illustrates an exploded view of an embodiment of a floor shield.

FIG. 16 shows another embodiment of a floor shield 1600. As shown, the floor shield 1600 can be composed of multiple portions, though some of the portions can be integrally formed. For example, the floor shield 1600 can have a main shelf 1602. The main shelf 1602 can be connected to a tucking tray top 1604, which can be connected to a tucking tray bottom 1606. Further, the main shelf 1602 can include at least one removable boss 1608. In some embodiments, the main shelf 1602, and thus the floor shield 1600, can be attached to a wall by a metal bar 1610 and main attachment magnets 1619.

Figure 17:
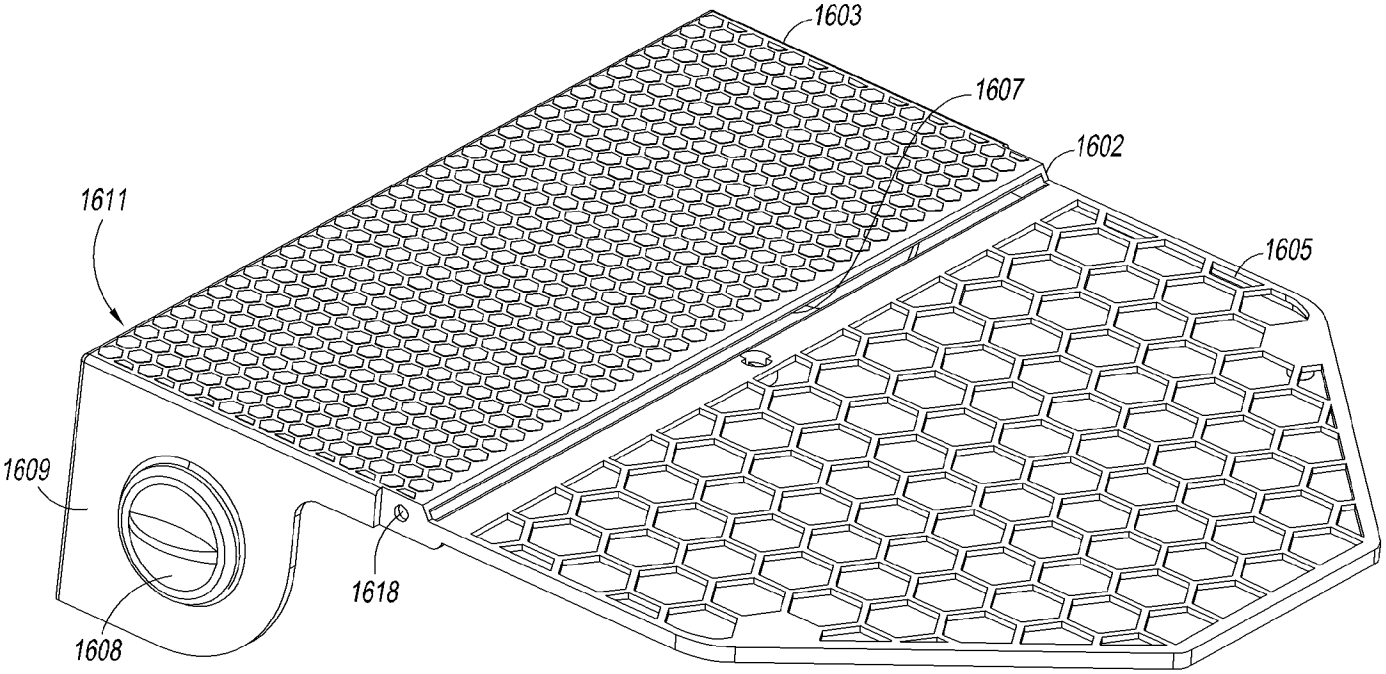
FIG. 17 illustrates an embodiment of a floor shield without a tucking tray top.

FIG. 17 shows an embodiment of the main shelf 1602 without the tucking tray top 1604. In some embodiments, the main shelf 1602 can have an upper platform 1603 and a lower platform 1605. As shown in FIG. 17, the lower platform 1605 can be shaped similar to half an octagon, though the particular shape of the lower platform 1605 does not limit the disclosure. In some embodiments, the lower platform 1605 can be made of a grid containing a plurality of openings as shown in FIG. 17. In some embodiments, the front edge of the lower platform 1605 can have a cutting mechanism, such as teeth, in order to cut any mats to the appropriate size without any tucking. In some embodiments, the grid may be triangles, squares, pentagons, hexagons, octagons, or combinations thereof, and the shape of the grid does not limit the disclosure. In some embodiments, the lower platform 1605 may be smooth and not contain any openings. In some embodiments, the lower platform 1605 can be configured to translate away from the upper platform 1603 while still remaining connected. For example, the lower platform 1065 can be configured to translate about 1, 2, 3, 4, 5, 6, 7, 8, 9, or 10 inches away from the upper platform 1603. In some embodiments, the lower platform 1065 can be configured to translate less than about 1, 2, 3, 4, 5, 6, 7, 8, 9, or 10 inches away from the upper platform 1603. In some embodiments, the lower platform 1065 can be configured to translate greater than about 1, 2, 3, 4, 5, 6, 7, 8, 9, or 10 inches away from the upper platform 1603.

In some embodiments, the lower platform 1605 may be connected to the upper platform 1603. In some embodiments, they may be removably connected. In some embodiments, they may be integrally formed. The connection between the lower platform 1605 and upper platform 1605 can form a slot 1607 allowing access between the top and bottom of the main shelf 1602. In some embodiments, the slot 1607 can be formed by having the upper and lower platforms 1603/1605 at different vertical heights. In some embodiments, the upper and lower platforms 1603/1605 can be at the same height and a gap can be formed between the two, thus forming the slot 1607. The slot 1607 can generally be the width of the main shelf 1602, though the size of the slot does not limit the disclosure.

The upper platform 1605 can contain sidewalls 1609 and a back wall 1611. The side walls 1609 can be configured to hold at least one boss, such as the removable boss 1608. In some embodiments, the sidewalls 1609 have the same width as the upper platform 1605. In some embodiments, the sidewalls 1609 have a greater width than the upper platform 1605. In some embodiments, the sidewalls 1609 have a smaller width than the upper platform 1605. In some embodiments, the sidewalls 1609 and back wall 1611 can be sized to retain a roll of mats.

Figure 18:
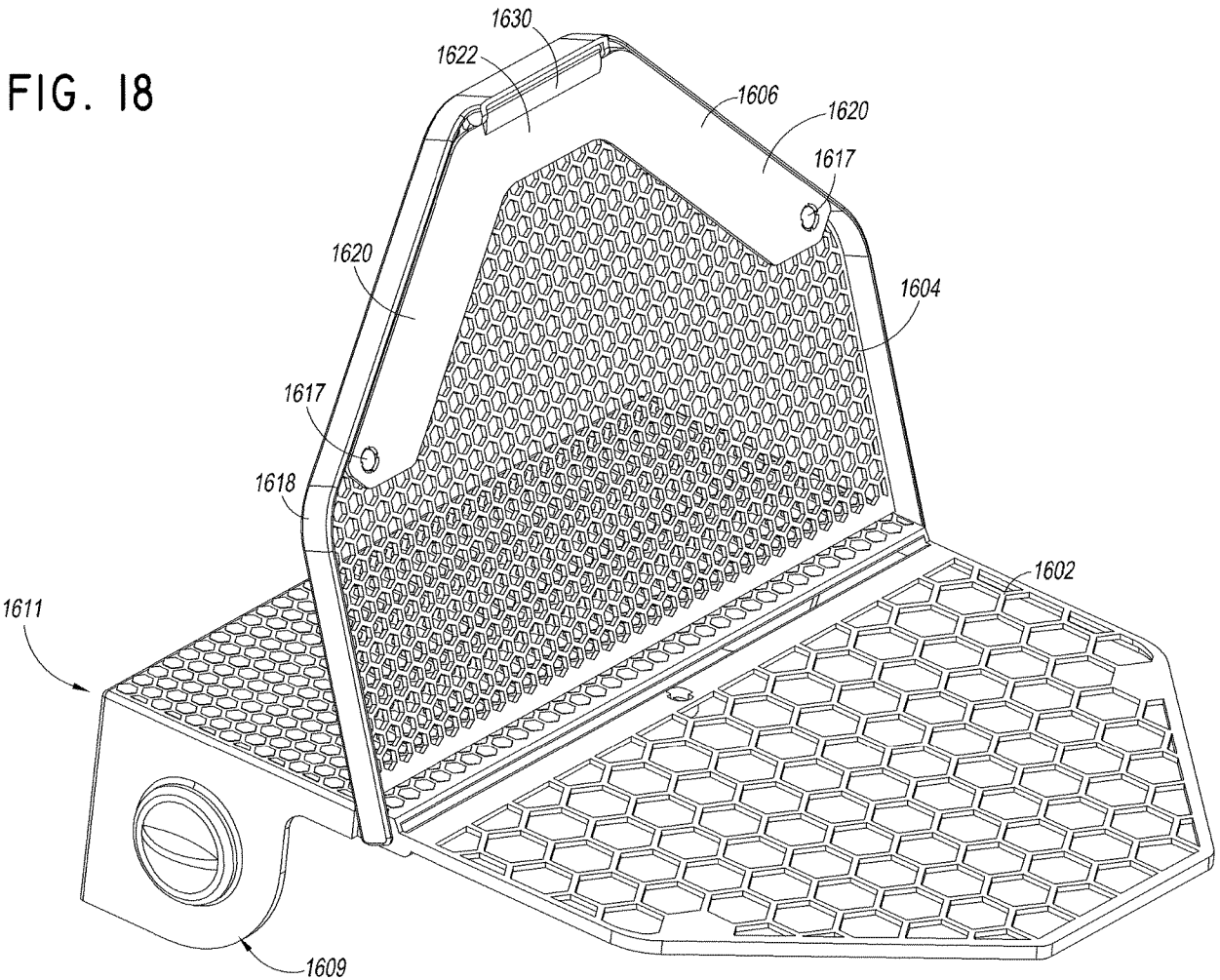
FIG. 18 illustrates an embodiment of a floor shield with an open tucking tray top.

FIG. 18 shows an embodiment with a tucking tray top 1604 rotatably connected to the main shelf 1602. The tucking tray top 1604 can be rotatably attached to the main shelf 1602 through the insertion of a tab in an aperture 1618 (shown in FIG. 17) on each side of the main shelf 1602. In some embodiments, the tucking tray top 1604 can be rotated from an open to a closed position. The tucking tray top 1604 can have a frame 1618 around its perimeter, wherein the frame 1618 is thicker than the rest of the tucking tray top 1604. As shown, the tucking tray top 1604 can be sized and shaped so that the frame 1618 generally surrounds the lower platform 1605 when in the closed position. In some embodiments, when in the opened position, the tucking tray top 1604 can rest against the upper platform 1605, which can allow the tucking tray top 1604 to remain open. In some embodiments, the tucking tray top 1604 can be held open by frictional forces between the tucking tray top 1604 and the main shelf 1602.

In some embodiments, the tucking tray top 1604 can have the frame 1618 surrounding a grid, similar to the lower platform 1605. The grid can have a plurality of apertures in some embodiments. In some embodiments, the tucking tray top 1604 can be generally flat with no apertures. In some embodiments, the grid may be triangles, squares, pentagons, hexagons, octagons, or combinations thereof, and the shape of the grid does not limit the disclosure. In some embodiments, the grid of the tucking tray top 1604 can be smaller than the grid of the lower platform 1605. In some embodiments, the grid of the tucking tray top 1604 can be larger than the grid of the lower platform 1605. In some embodiments, the grid of the tucking tray top 1604 can be generally the same size as the grid of the lower platform 1605. In some embodiments, the grid of the tucking tray top 1604 can have the same shapes as the grid of the lower platform 1605. In some embodiments, the grid of the tucking tray top 1604 can have different shapes than the grid of the lower platform 1605.

Further, FIG. 18 shows a tucking tray bottom 1606 attached to the tucking tray top 1604 which is used in some embodiments. In some embodiments, the tucking tray bottom 1606 may not be used. The tucking tray bottom 1606 can be generally sized and shaped to fit within the frame 1618 of the tucking tray top 1604 so that the tucking tray bottom 1606 is not exposed within the closed position. In some embodiments, the tucking tray bottom 1606 can fit again the edge of the tucking tray top 1604. In some embodiments, the tucking tray bottom 1606 can be shaped in a general c-shape, though the shape of the tucking tray bottom 1606 does not limit the disclosure. In some embodiments, the tucking tray bottom 1606 can be formed from two arms 1620 attached to a connection portion 1622.

Figure 19:
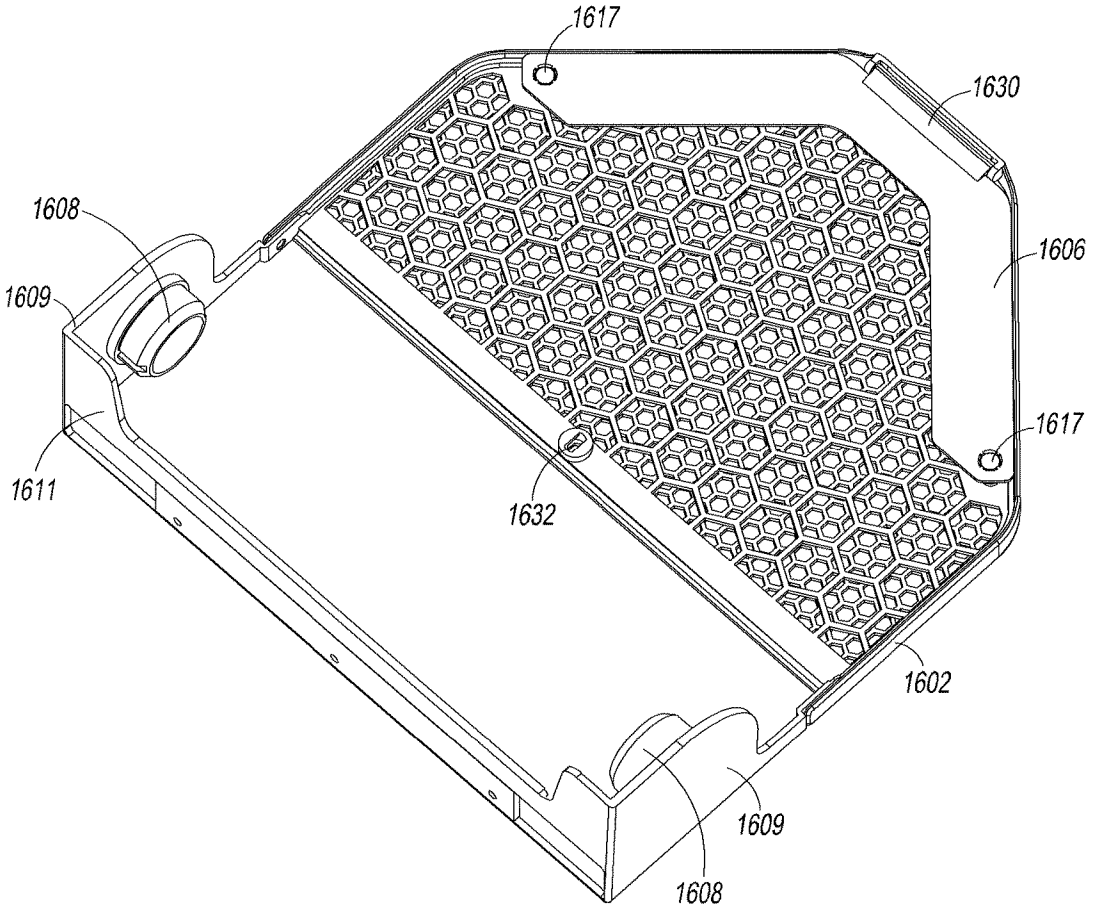
FIG. 19 illustrates an underside view of an embodiment of a floor shield.

FIG. 19 illustrates the tucking tray bottom 1606 when the floor shield 1600 is in the closed position. As shown, the tucking tray bottom 1606 can be releasably attached to the tucking tray top 1604 through an engagement mechanism 1630. Further, the tucking tray bottom 1606 can be attached to the underside of the main shelf 1602 through magnetic latching components 1612 on the main shelf 1602. The tucking tray bottom 1606 can have an engagement portion 1615 and magnetic latching component 1611, shown in FIG. 16, to facilitate attachment to the tucking tray top 1604.

The magnetic latching components 1617/1612 can be circular magnetic pieces having opposite poles in order to magnetically connect to one another, though the shape of the magnetic pieces does not limit the disclosure. In some embodiments, a force can be used to release the corresponding magnetic latching components 1617/1612. In some embodiments, two magnetic latching components 1617/1612 can be used on each of the main shelf 1602 and tucking tray bottom 1606, though the amount of magnetic latching components 1617/1612 does not limit the disclosure. In some embodiments, 1, 2, 4, 5, or 6 magnetic latching components 1617/1612 can be used on each of the main shelf 1602 and tucking tray bottom 1606. In some embodiments, the magnetic latching components 1617 can be located on opposite ends of the arms 1620 of the tucking tray bottom 1606, though the position does not limit the disclosure and the magnetic latching components 1617 can be used throughout the tucking tray bottom 1606.

Figure 20:
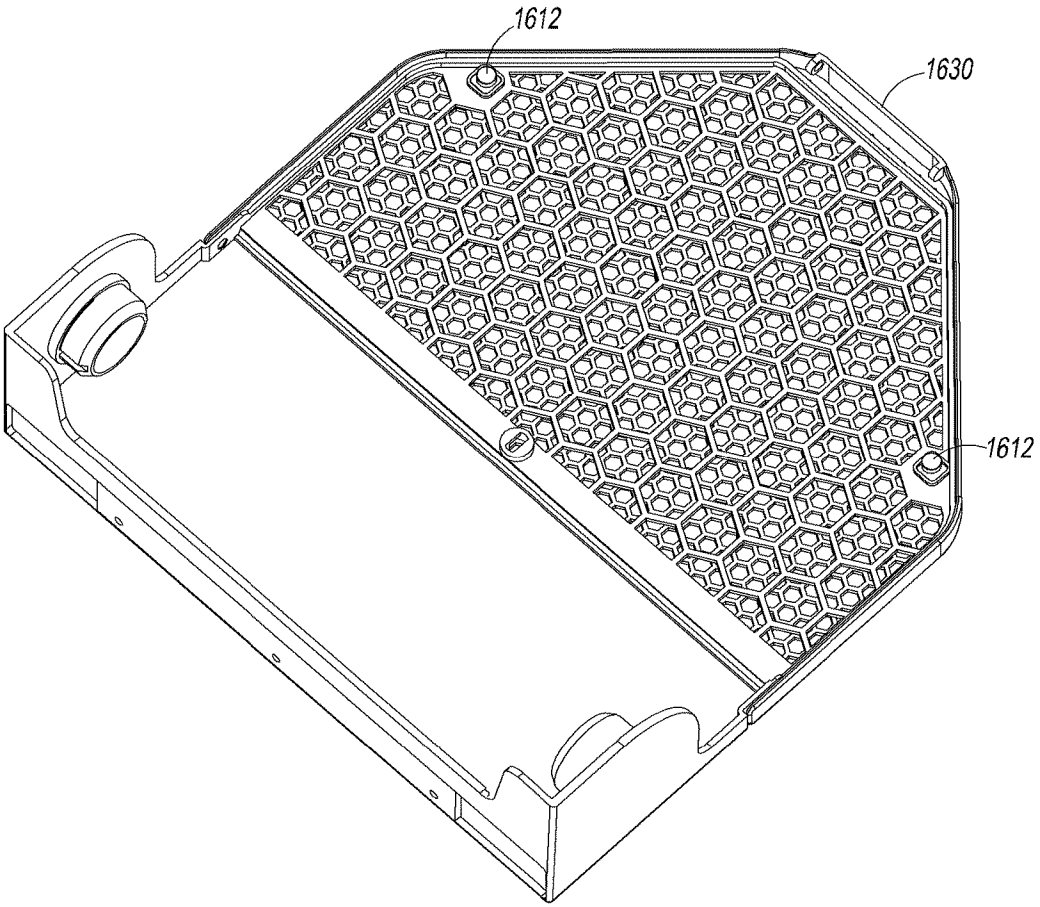
FIG. 20 illustrates an underside view of an embodiment of a floor shield without a tucking tray bottom.
Figure 2I:
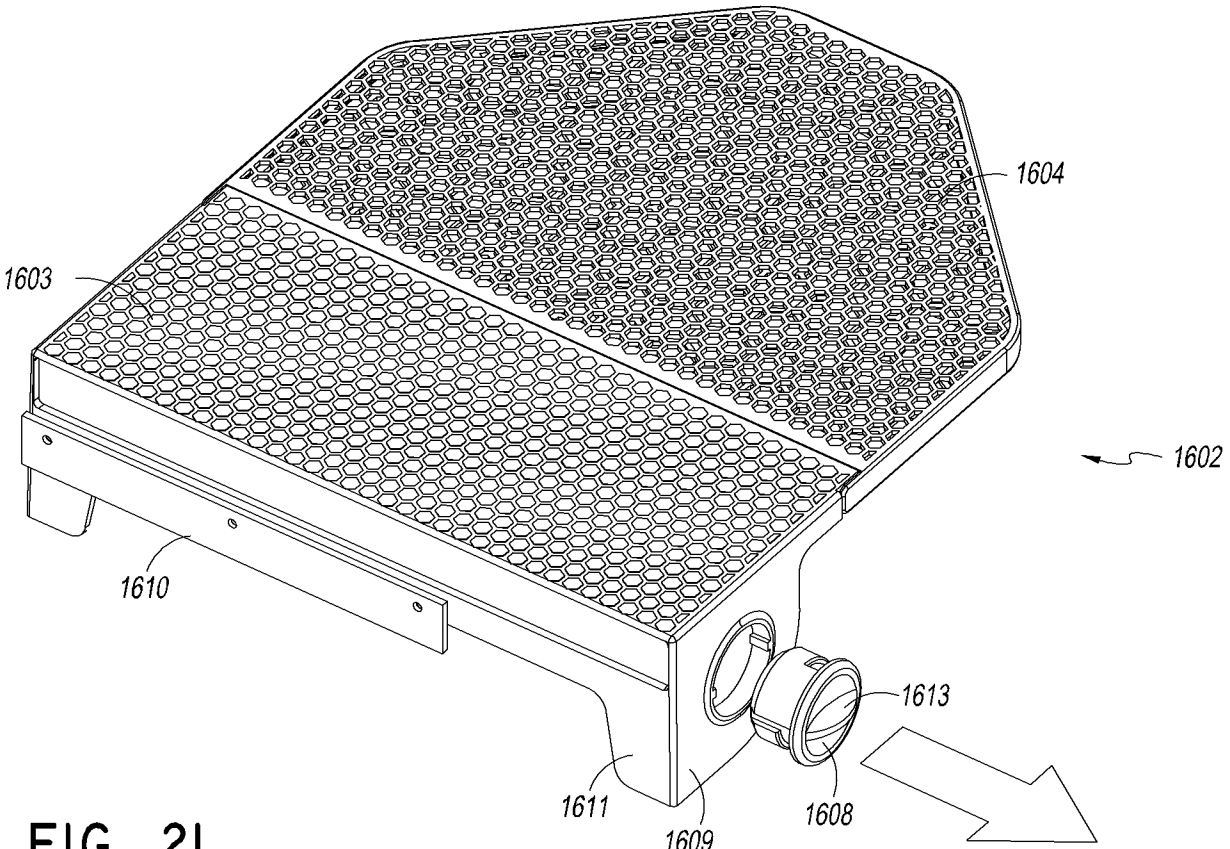

The tucking tray bottom 1606 can be releasably attached to the tucking tray top 1604 through the use of an engagement mechanism 1630 of the tucking tray top 1606 attached to engagement portion 1615 of the tucking tray bottom 1606. The engagement mechanism 1630 can be configured to be a clipping mechanism that can hold the engagement portion 1615. A user can release the engagement mechanism 1630 by applying pressure, thereby opening the engagement mechanism 1630, as shown in FIG. 20. Through the combination of the engagement mechanism 1630 and magnetic latching components 1617/1612, the tucking tray bottom 1606 can be releasably attached within the tucking tray top 1604. Accordingly, the tucking tray bottom 1606 can be releasably attached to both the tucking tray top 1604 and the main shelf 1602. Further, in some embodiments the tucking tray bottom 1606 can be stored on the tucking tray top 1604 when in the open position, as shown in FIG. 18.

FIGS. 21-24 illustrate an embodiment of incorporating mats into the floor shield 1600. As shown in FIG. 21, at least one of the removable bosses 1608 can be removed. The removable boss 1608 may be attached to the floor shield 1600 in any type of method, such as through screw, friction, or interference, and the attachment of the removable boss 1608 to the floor shield 1600 does not limit the disclosure. In some embodiments, the removable boss 1608 may have a gripping portion 1613, such as a handle, to aid a user in removing the removable boss 1608. In some embodiments, the removable boss 1608 can be removed by a twisting motion.

Figure 22:
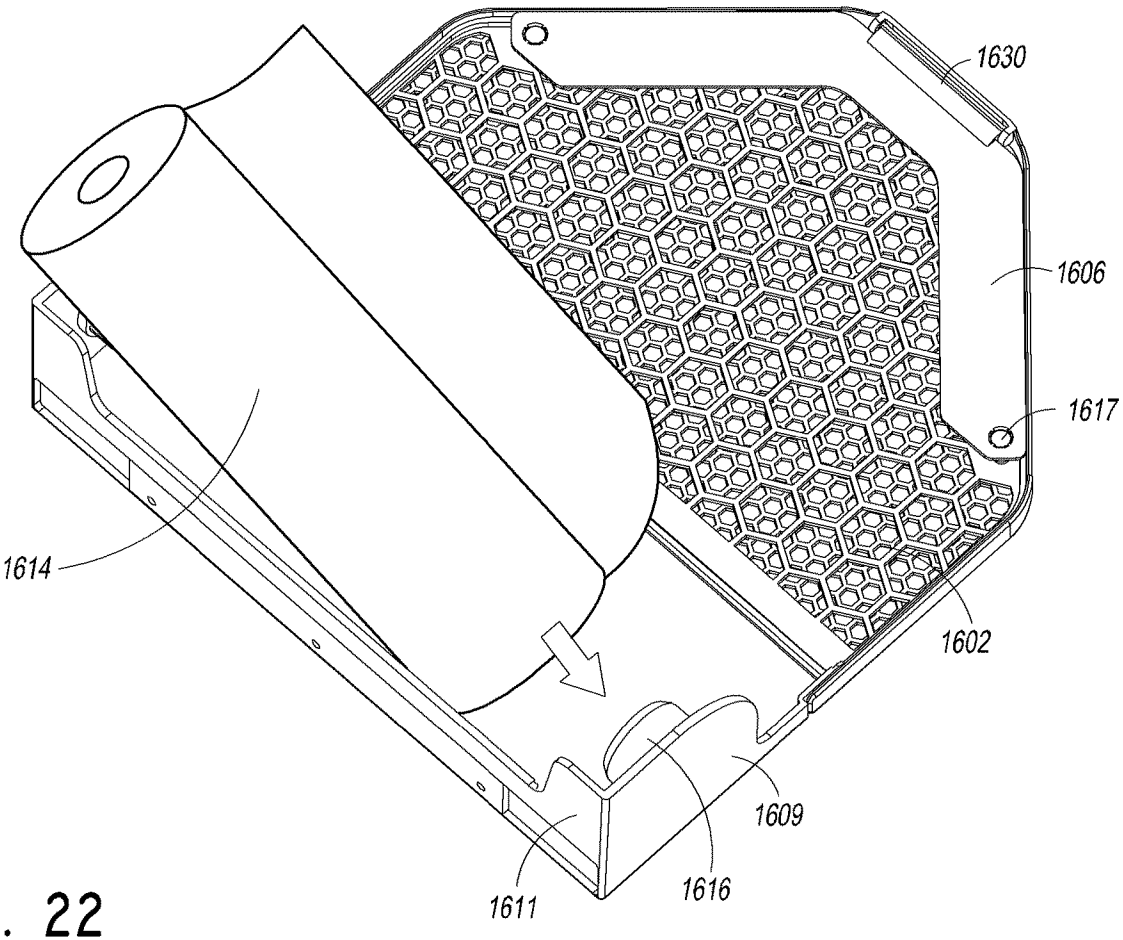
FIG. 22 illustrates a step in the installation of a mat into an embodiment of a floor shield.

Upon removable of at least one of the removable bosses 1608, a roll of mats 1614 can be inserted into the floor shield 1600, shown in FIG. 22. The roll of mats 1614 can be inserted into another boss 1616, which may or may not be removable. The removable boss 1608 can then be reinserted into the floor shield 1600 so that the roll of mats 1614 can be rotatably held in place by the bosses 1608/1616.

Figure 23:
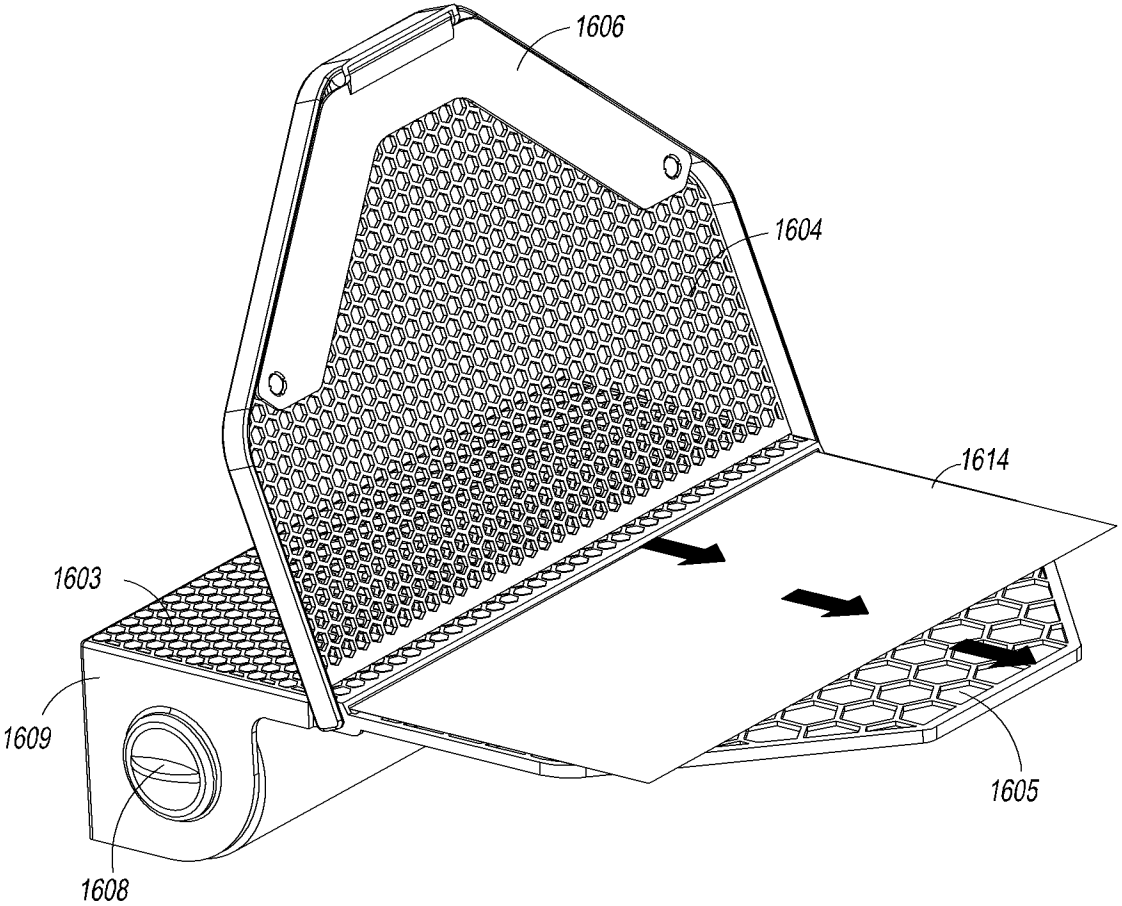
FIG. 23 illustrates the application of a mat into an embodiment of a floor shield.
Figure 24:
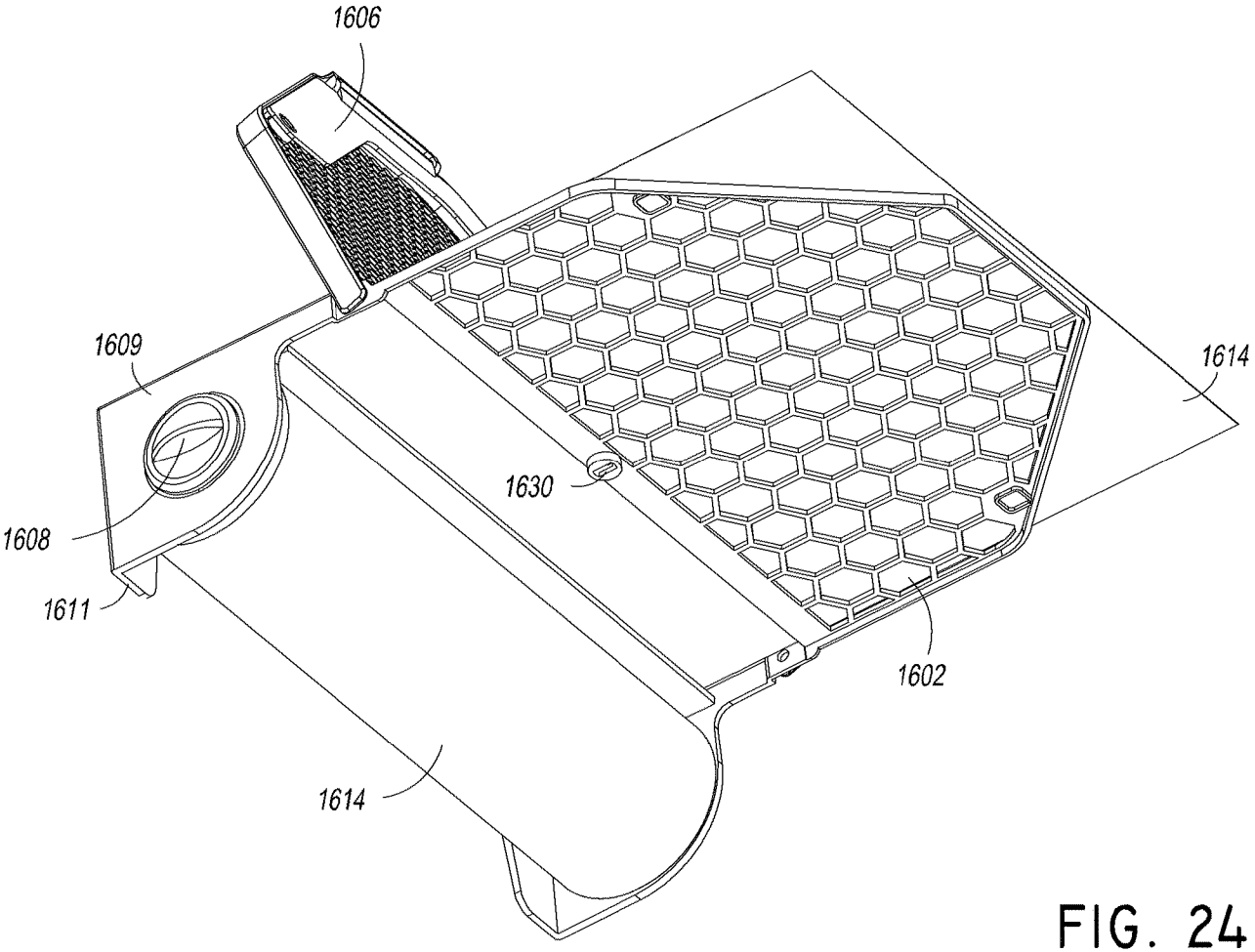
FIG. 24 illustrates a mat held within a top retainer in an embodiment of a floor shield.

Once the mats are incorporated into the floor shield 1600, one of the mats 1614 can be pulled through the slot 1607 when the floor shield 1600 is in the open position, as shown in FIG. 23. The matt 1614 can be pulled to the edge of the main shelf 1602. FIG. 24 shows a bottom view of the floor shield 1600 with the matt 1614 pulled over the edge of the main shelf 1602. The tucking tray bottom 1606 can then be removed, the corners of the matt 1614 can be folder over, and the tucking tray bottom 1606 can be replaced, thus holding the matt 1614 in place on the floor shield 1600.

Figure 25:
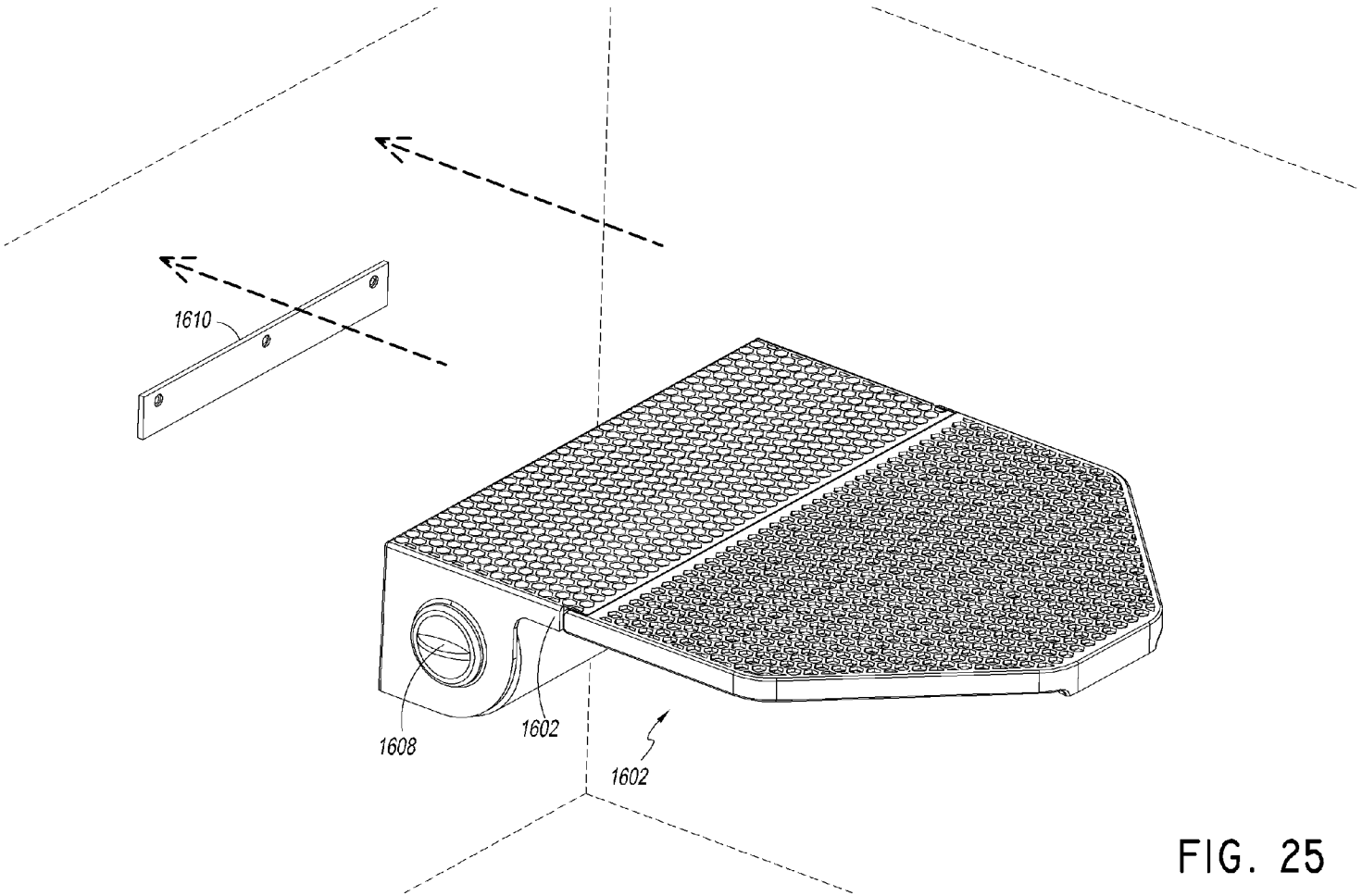
FIG. 25 illustrates an attachment mechanism for an embodiment of a floor shield.

FIG. 25 shows an embodiment of attachment of the floor shield 1600 to a wall, though other methods can be used as well as disclosed above, and the attachment method does not limit the disclosure. As shown, brackets, such as a metal bar 1610, can be attached to a wall, such as a wall of a restroom underneath a urinal shown in FIG. 25. The metal bar 1610 can be, for example, steel, though the type of material does not limit the disclosure. The metal bar 1610 can be magnetic in some embodiments. The metal bar 1610 can be screwed into the wall, though the attachment of the metal bar 1610 to the wall does not limit the disclosure and any attachment means, such as adhesive, can be used as well. In some embodiments, the metal bar 1610 has a width less than that of the floor shield 1600. Accordingly, floor shield 1600 can define a slot for receiving the metal bar 1610 or bracket, as shown in FIG. 21, such that the bracket is slideable within the slot. In some embodiments, the metal bar 1610 has a width that is the same as that of the floor shield 1600. In some embodiments, the metal bar 1610 has a width greater than that of the floor shield 1600.

Main attachment magnets 1612 (e.g., releasable attachment portions) can be attached to the back of the floor shield 1600, as shown in FIG. 16. A number of main attachment magnets 1612 can be used, or a single main attachment magnets 1612 can be used. The main attachment magnets 1612 can be attached to the floor shield 1600 through, for example, adhesive, though the attachment does not limit the disclosure. If a plurality of main attachment magnets 1612 are used, 2, 3, 4, 5, 6, or 7 main attachment magnets 1612 can be used, and the number of main attachment magnets 1612 does not limit the disclosure.

Once both the metal bar 1610 and the main attachment magnets 1612 are in place, the floor shield 1600 can be releasably attached to the wall. In some embodiments, the magnetic hold between the metal bar 1610 and the main attachment magnets 1612 is sufficient so that small incidental forces do not separate the metal bar 1610 and the main attachment magnets 1612. In some embodiments, a significant force, such as an average user stepping on the floor shield 1600 can be the minimum force needed to separate the metal bar 1610 and the main attachment magnets 1612. As discussed above, other attachment mechanisms or releasable attachment portions can be used, such as a snap mechanism, to attach the floor shield 1600 to the bracket.

In some embodiments, the floor shield 1600 can contain a locking mechanism 1632. The locking mechanism 1632 can be on the bottom of the floor shield 1600, though the position of the locking mechanism 1632 does not limit the disclosure. The locking mechanism 1632 can be used to lock the tucking tray top 1604 to the main shelf 1602, thus preventing opening of the floor shield 1600 by an unwanted party.

Figure 26:
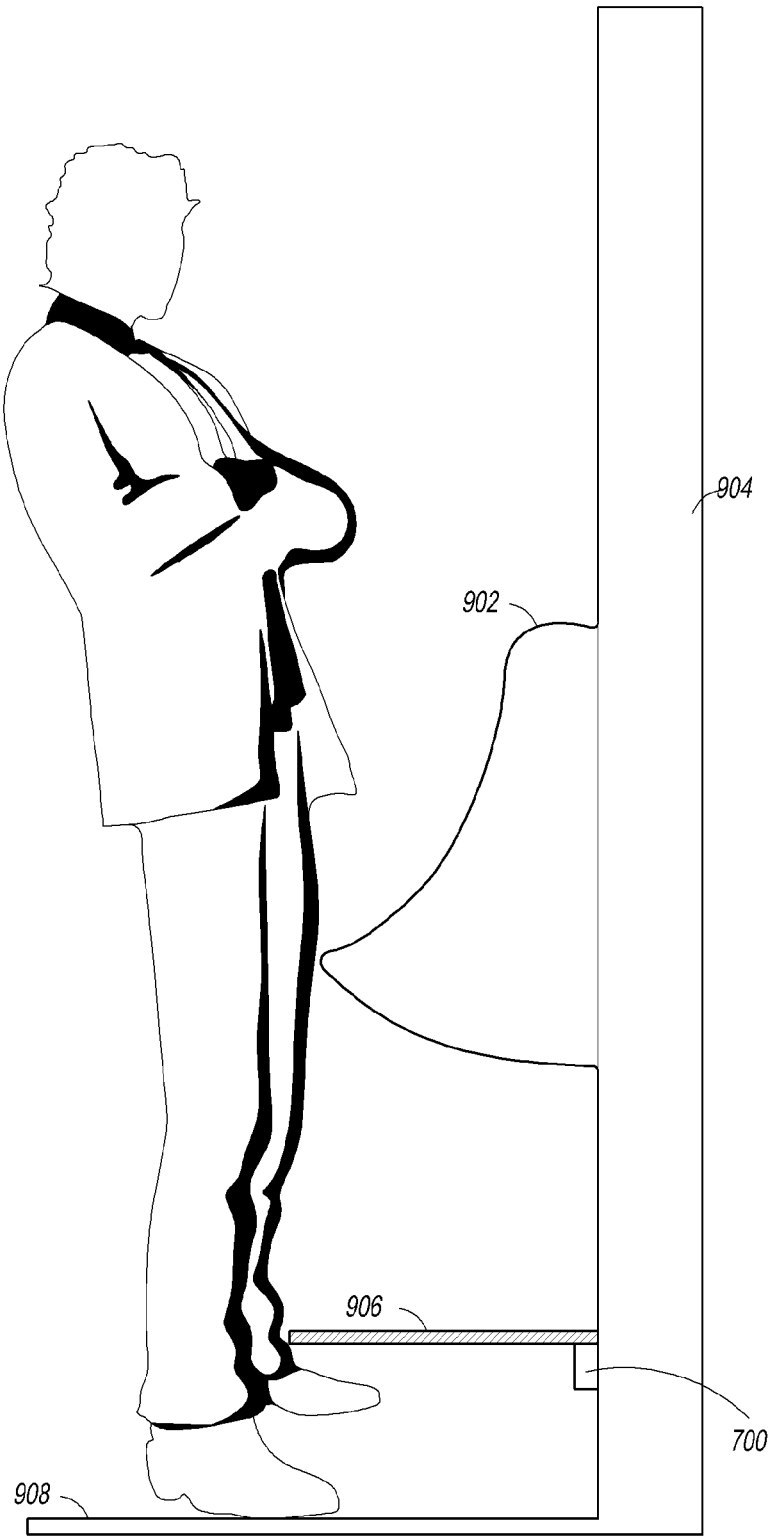
FIG. 26 illustrates a side view of a user at a urinal with an embodiment of a floor shield.

FIGS. 26 and 27 both illustrate embodiments of a floor shield assembly being used with a urinal. As shown in FIG. 26, a user can position at a urinal 902. When in the proper person, the user's shoes can be located below the floor shield 906 of the floor shield assembly. Further, in some embodiments the bottom of a user's pant legs can be located beneath the floor shield 906. As discussed in detail above, the floor shield 906 can be used in order to adequately cover a user's shoes. FIG. 27 illustrates a top viewpoint of the user in FIG. 26. As shown, a user's shoes can be located directly underneath the floor shield 906, thus protecting the user's shoes from splash.

Figure 28:
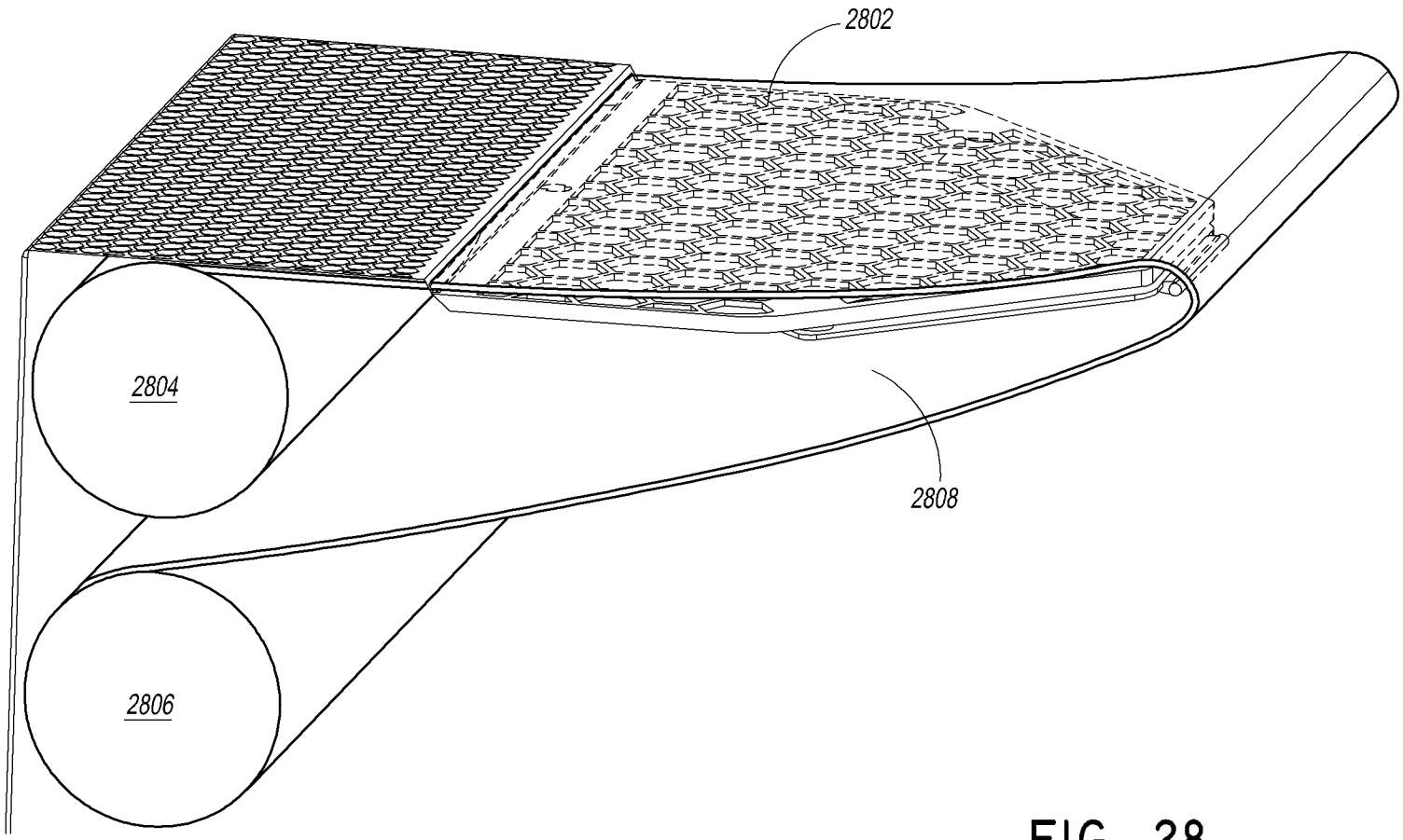
FIG. 28 illustrates an embodiment of an automated floor shield.

FIG. 28 illustrates an embodiment of an automated floor shield. As shown, a new mat role 2804 can be located under the floor shield, such as those described in detail above. A clean mat 2802 can be rolled onto the floor shield. As the clean mat 2802 becomes soiled through use, it can be advanced so that the dirty mat 2808 can be located underneath the floor shield. As further mats are soiled, they can be rolled into a used mat roll 2806. The entire advancement and rolling can be automated, such as with a controller or switch as discussed above, thus allowed for the mats to be continuously refreshed without the user having any contact with the soiled mats. The used mat roll 2806 can then be removed. If the mats are reusable, the mats can be washed. Otherwise, the mats can be disposed of. While FIG. 28 shows a specific positioning of the new mat roll 2804 and used mat roll 2806, different configurations can be used as well, such as the used mat roll 2806 being located on the opposite side of the floor shield from the new mat roll 2804. Accordingly, the positioning of the mats does not limit the disclosure.

From the foregoing description, it will be appreciated that an inventive floor shield is disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations and/or "some embodiments" can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A floor shield assembly comprising:

a frame structure comprising:

an upper frame portion;

a lower frame portion; and a tucking tray bottom engaged to the lower frame portion with a magnetic latching component;

wherein the upper and lower frame portions are connected by an attachment structure located on a first side of the frame structure configured to releasably connect the upper and lower frame portions; and wherein the upper frame portion is configured to move between an open and a closed configuration;

at least one replaceable mat having an upward facing surface and a downward facing surface, wherein the at least one replaceable mat can be retained between the upper and lower frame portions of the frame structure, and between the lower frame portion and the tucking tray bottom, when the upper frame portion is in the closed configuration so the upper frame portion surrounds the upward facing surface of the at least one replaceable mat; and a bracket located on a second side of the frame structure generally opposite the first side and configured to retain at least a portion of the frame structure, the bracket configured to connect to a wall;

wherein the floor shield assembly is configured to be located above a floor.

2. The floor shield assembly of claim 1, wherein the bracket comprises a container defining a cavity for receiving replacement mats.

3. The floor shield assembly of claim 2, wherein the container comprises at least one removable boss for removal and replacement of the replacement mats.

4. The floor shield assembly of claim 1, wherein the frame structure is configured to move horizontally with respect to the bracket.

5. The floor shield assembly of claim 1, wherein at least one of the top or bottom portions of the frame structure comprises at least one fastening element.

6. The floor shield assembly of claim 5, wherein the at least one fastening element comprises a locking pin or snap.

7. The floor shield assembly of claim 1, wherein the attachment structure is a hinge.

8. The floor shield assembly of claim 1, wherein the frame structure is configured to rotate with respect to the bracket about an axis.

9. The floor shield assembly of claim 1, wherein air freshener is incorporated into at least one of the frame structure, the at least one replaceable mat, and the bracket.

10. The floor shield assembly of claim 1, further comprising a locking mechanism.

11. The floor shield assembly of claim 1, further comprising a plurality of replaceable mats, in addition to the at least one replacement mat.

12. The floor shield assembly of claim 11, wherein said plurality of replaceable mats are positioned on a roll.

13. The floor shield assembly of claim 11, wherein said plurality of replaceable mats are connected to said at least one replaceable mat.

14. The floor shield assembly of claim 13, wherein said plurality of replaceable mats are configured to be connected to said at least one replaceable mat while the at least one replaceable mat is retained between the upper and lower frame portions of the frame structure.

15. A system for clothing protection in a restroom comprising:

a wall;

at least one urinal attached to the wall; and at least one floor shield assembly comprising:

a frame structure including a releasable attachment portion;

a replaceable mat sized to be supported by the frame structure, wherein the replaceable mat is securable to the frame structure; and a bracket configured to retain the frame structure, wherein the bracket is attached to the wall below the lowest point of the urinal, wherein the frame structure is releasably attached to the bracket such that a force on the frame structure above a threshold causes the frame structure to release from the bracket and wherein force exerted by the releasable attachment portion mounts the frame structure to the bracket;

wherein the replaceable mat is positioned to protect a user from splashing of urine and is spaced from a floor of the restroom and below a rim of the at least one urinal.

16. The system of claim 15, wherein the at least one floor shield assembly is spaced below the urinal.

17. The system of claim 15, wherein the frame structure comprises a top and bottom portion, the top and bottom portion connected by an attachment structure, and the replaceable mat located between the top and bottom portions of the frame structure.

18. The system of claim 15, wherein the bracket is secured to the wall without drilling.

19. The system of claim 15, said releasable attachment portion comprising at least one magnet.

20. A system for clothing protection in a restroom, comprising:

at least one floor shield assembly comprising:

a frame structure including a releasable attachment portion;

a replaceable mat sized to be supported by the frame structure; and a bracket configured to be connected to the frame structure;

wherein the frame structure defines a slot for receiving the bracket, wherein the frame structure is releasably attached to the bracket such that a force on the frame structure above a threshold causes the frame structure to release from the bracket and force exerted by the releasable attachment portion mounts the frame structure to the bracket, wherein further, the bracket and the slot in the frame are sized and configured such that the bracket is slideable within the slot of the frame structure.

21. The system of claim 20, said releasable attachment portion comprising at least one magnet.

* * * * *